US011525335B2

(12) United States Patent
Angel et al.

(10) Patent No.: US 11,525,335 B2
(45) Date of Patent: Dec. 13, 2022

(54) APPARATUS AND METHODS FOR INSPECTING AND CLEANING SUBSEA FLEX JOINTS

(71) Applicant: BP Corporation North America Inc., Houston, TX (US)

(72) Inventors: Christopher Eric Angel, Houston, TX (US); Eric Lee Harden, Cypress, TX (US); Stuart Douglas Partridge, Houston, TX (US); Andrew J. Guinn, Cypress, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 16/670,532

(22) Filed: Oct. 31, 2019

(65) Prior Publication Data

US 2020/0063528 A1 Feb. 27, 2020

Related U.S. Application Data

(63) Continuation of application No. 14/322,277, filed on Jul. 2, 2014, now Pat. No. 10,508,516, which is a (Continued)

(51) Int. Cl.

| | |
|---|---|
| ***E21B 37/00*** | (2006.01) |
| ***E21B 17/08*** | (2006.01) |
| *B08B 9/02* | (2006.01) |

(52) U.S. Cl.

CPC ..... *E21B 37/00* (2013.01); *E21B 17/085* (2013.01); *B08B 9/02* (2013.01)

(58) Field of Classification Search

CPC ..... B08B 9/023; B08B 3/024; Y10S 118/11; B05B 13/0436; B63B 59/10; B21B 17/006; B21B 17/01; B21B 17/015; E21B 37/00

(Continued)

(56) References Cited

U.S. PATENT DOCUMENTS

| | | | |
|---|---|---|---|
| 2,193,971 | A | 3/1940 | Laurent |
| 3,495,288 | A | 2/1970 | Ford |

(Continued)

OTHER PUBLICATIONS

Oil States, Steel Caternary Riser Technology, SCR Flex Joints, 2003, 1-4, Oil States, Arlington, USA.

(Continued)

*Primary Examiner* — Marc Lorenzi

(74) *Attorney, Agent, or Firm* — Conley Rose, P.C.

(57) ABSTRACT

A remotely operated device for inspecting and/or cleaning a subsea flexible pipe joint comprises a support assembly. In addition, the device comprises a tool positioning assembly coupled to the support assembly. The tool positioning assembly includes a rotating member disposed about a central axis. The tool positioning assembly is rotatable relative to the support assembly about the central axis. Further, the device comprises a cleaning assembly including a cleaning device adapted to clean the flexible pipe joint. The cleaning device is axially moveable relative to the rotating member. Still further, the device comprises a clamping assembly coupled to the support assembly. The clamping assembly has an open position disengaged with the section of the flexible pipe joint and a closed position engaging the section of the flexible pipe joint.

10 Claims, 17 Drawing Sheets

Related U.S. Application Data continuation of application No. 12/644,177, filed on Dec. 22, 2009, now Pat. No. 8,800,575.

(60) Provisional application No. 61/152,889, filed on Feb. 16, 2009, provisional application No. 61/141,537, filed on Dec. 30, 2008.

(58) Field of Classification Search
USPC ..... 118/305, 307; 15/55, 88.2, 88.3, 88.4, 15/362; 166/170, 173, 174, 241.6, 241.7, 166/250, 5, 311; 134/122 R, 172, 180, 134/199
See application file for complete search history.

(56) References Cited

U.S. PATENT DOCUMENTS

| | | | |
|---|---|---|---|
| 3,933,519 | A | 1/1976 | Koch et al. |
| 4,007,705 | A | 2/1977 | Sherer et al. |
| 4,044,749 | A | 8/1977 | Bowen et al. |
| 4,110,862 | A | 9/1978 | Buzhinsky et al. |
| 4,176,269 | A | 11/1979 | Merrick et al. |
| 4,205,694 | A | 6/1980 | Thompson et al. |
| 4,720,213 | A | 1/1988 | Gernhardt et al. |
| 5,052,423 | A | 10/1991 | Chapman et al. |
| 5,069,234 | A | 12/1991 | Nielsen |
| 5,085,016 | A | 2/1992 | Rose |
| 5,136,969 | A | 8/1992 | Chapman |
| 5,191,740 | A | 3/1993 | Rose |
| 5,238,331 | A | 8/1993 | Chapman |
| 5,267,417 | A | 12/1993 | Rose |
| 5,361,791 | A | 11/1994 | Chapman et al. |
| 5,385,609 | A | 1/1995 | Rose et al. |
| 5,522,941 | A | 6/1996 | Uchinami et al. |
| 5,615,696 | A | 4/1997 | Lawler |
| 6,371,696 | B1 | 4/2002 | Eathorne |
| 6,881,266 | B1 | 4/2005 | Daykin et al. |
| 7,059,945 | B2 | 6/2006 | Skinner |
| 7,331,846 | B1 | 2/2008 | Shimizu et al. |
| 7,341,283 | B2 | 3/2008 | Moses et al. |
| 7,442,256 | B2 | 10/2008 | Sela et al. |
| 3,057,607 | A1 | 11/2011 | Gardner et al. |
| 2008/0313915 | A1* | 12/2008 | Dos Santos ..... E21B 47/00 33/568 |
| 2009/0252559 | A1 | 10/2009 | Masters et al. |
| 2011/0159192 | A1 | 6/2011 | Daykin et al. |

OTHER PUBLICATIONS

Konsberg, OE14-112/113 User Manual, Jun. 2008, 1-8, Kongsberg, Aberdeen, Scotalnd.

* cited by examiner

APPARATUS AND METHODS FOR INSPECTING AND CLEANING SUBSEA FLEX JOINTS

CROSS-REFERENCE TO RELATED APPLICATIONS

This application is a Continuation application of U.S. patent application Ser. No. 14,322,277 filed on Jul. 2, 2014, entitled "Apparatus and Methods for Inspecting and Cleaning Subsea Flex Joints", which is a Continuation application of U.S. patent application Ser. No. 12/644,177 filed on Dec. 22, 2009, entitled, "Apparatus and Methods for Inspecting and Cleaning Subsea Flex Joints", which claims benefit of U.S. provisional application Ser. No. 61/141,537 filed Dec. 30, 2008, entitled "Flex Joint Cleaning Tool," this application also claims benefit of U.S. provisional application Ser. No. 61/152,889 filed Feb. 16, 2009, entitled "Flex Joint Cleaning Tool," which are all hereby incorporated herein by reference in entirety.

STATEMENT REGARDING FEDERALLY SPONSORED RESEARCH OR DEVELOPMENT

Not applicable.

BACKGROUND

Field of the Invention

This disclosure relates generally to the field of subsea interventions. More specifically, the disclosure relates to devices and methods for cleaning subsea flex joints.

Background of the Technology

In many offshore operations, subsea pipestring or riser extending from subsea equipment to a rig or other structure at the surface of the water provides communication between the subsea well and the surface structure. For example, a completed subsea well may have a riser assembly that extends from the subsea production equipment disposed on the sea floor to a wellhead on the surface structure (e.g., productions platform). Such pipestrings and risers are usually constructed of a plurality of rigid pipe segments coupled together end-to-end by flexible pipe joints. This arrangement allows the riser to be laid out subsea in a non-vertical orientation, and then raised at one end and coupled to an offshore platform in a generally vertical orientation.

Subsea risers are typically supported in tension by the surface structure and affixed to the subsea equipment by a stress joint. Riser are subjected to a variety of loads and stresses while suspended from the surface. For example, ocean currents, wave motions and other external forces may create large bending stresses in the riser, which can lead to damage to and/or failure of the stress joint connecting the riser assembly to the subsea equipment. An uppermost joint proximal the surface structure is usually a swivel joint that allows for rotation of the riser assembly about its longitudinal axis, and the joints disposed between each rigid pipe section are usually flexible joints that allow bending of the riser. In other words, the flexible joints accommodate limited movement of the individual pipe sections relative to each other.

Moreover, there has been a continuing trend to employ offshore drilling and production facilities in increasingly deeper water and in geographical regions that experience harsh weather conditions such as the North Sea. Offshore drilling and production facilities in such dynamic ocean environments can experience extreme load conditions on the risers and mooring system components. Extreme weather conditions alone, or in combination with equipment failures, may result in complex, simultaneous translational and rotational motions of the platform.

Most conventional subsea flexible pipe joints for use in risers include component(s) constructed of elastomeric materials, which may become encrusted with marine life and/or algae. Such build-up on the elastomeric materials may make inspection of the flex joint for any signs of damage or malfunction very difficult. In the past, human divers were used to clean the elastomeric materials in subsea flexible joints using a water blaster. However, the use of divers is not a particularly desirable solution for cleaning subsea joints because of a variety of operational and safety issues. For example, the use of human divers requires a dive spread put on the production platform, typically requires a complete halt or reduction in platform operations during the dive, and due to subsea visibility, may be limited to daylight hours.

Accordingly, there remains a need in the art for devices and methods for safely cleaning subsea flex joints. Such devices and methods would be particularly well received if they cleaned subsea flex joints without necessitating the reduction or halting of other platform operations.

BRIEF SUMMARY OF THE DISCLOSURE

These and other needs in the art are addressed in one embodiment by a remotely operated device. In an embodiment, the remotely operated device comprises a support assembly including a first inner capture cavity and a first access opening. The first inner capture cavity is adapted to receive a section of a subsea flexible pipe joint through the first access opening. In addition, the remotely operated device comprises a tool positioning assembly coupled to the support assembly. The tool positioning assembly includes a rotating member disposed about a central axis. The rotating member includes a second inner capture cavity and a second access opening. The second inner capture cavity is adapted to receive the section of the flexible pipe joint through the second access opening. The tool positioning assembly is rotatable relative to the support assembly about the central axis. Further, the remotely operated device comprises a cleaning assembly including a cleaning device adapted to clean the flexible pipe joint. The cleaning device is axially moveable relative to the rotating member. Still further, the remotely operated device comprises a clamping assembly coupled to the support assembly. The clamping assembly has an open position disengaged with the section of the flexible pipe joint and a closed position engaging the section of the flexible pipe joint.

These and other needs in the art are addressed in another embodiment by a remotely operated subsea system. In an embodiment, the remotely operated subsea system comprises a device for inspecting and cleaning a subsea flexible pipe joint. The device for inspecting and cleaning includes a tool positioning assembly including a rotating member disposed about a central axis. The rotating member includes an inner capture cavity and an access opening extending from the inner capture cavity to an environment external the device. The tool positioning assembly is controllably rotatable about the central axis. In addition, the device includes a cleaning device for cleaning the flexible pipe joint. The cleaning device is moveably coupled to the rotating member.

Further, the device includes a camera for inspecting the flexible pipe joint, wherein the camera is moveably coupled to the rotating member. Still further, the device includes a clamping assembly coupled to the rotating member. The clamping assembly includes a first clamping arm and a second clamping arm disposed on opposite sides of the central axis, and a clamp motor adapted to actuate the clamping arms from a first position engaging a second of the flexible pipe joint and a second position withdrawn from the flexible pipe joint. Moreover, the remotely operated subsea system comprises a deployment skid adapted to receive the device, wherein the deployment skid includes a pump chamber.

These and other needs in the art are addressed in another embodiment by a method for cleaning a subsea flexible pipe joint having a longitudinal axis. In an embodiment, the method comprises deploying a remotely operated inspection and cleaning device subsea. The device includes a cleaning device. In addition, the method comprises remotely operating the device to engage a portion of the subsea flexible pipe joint. Further, the method comprises remotely operating the cleaning device to clean at least a portion of the flexible pipe joint.

Apparatus and methods for inspecting and/or cleaning subsea flexible joints are disclosed herein. Embodiments disclosed herein provide remote access to a flex element of a subsea flexible joint and three degrees of movement for enhanced inspection and cleaning operations. Two degrees of movement are provided by a combination of a tool positioning assembly that allows for controlled rotation and radial motions along a guide assembly. The third degree of movement is provided by the cleaning tool itself which is may be axially extended or retracted. In addition, embodiments disclosed herein include a cavitation nozzle to provide enhanced cleaning power. Accordingly, embodiments disclosed herein offer the potential for improved remote inspection and/or cleaning of a subsea flexible joint. Other aspects and advantages of the tool are described in more detail below.

The foregoing has outlined rather broadly the features and technical advantages of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
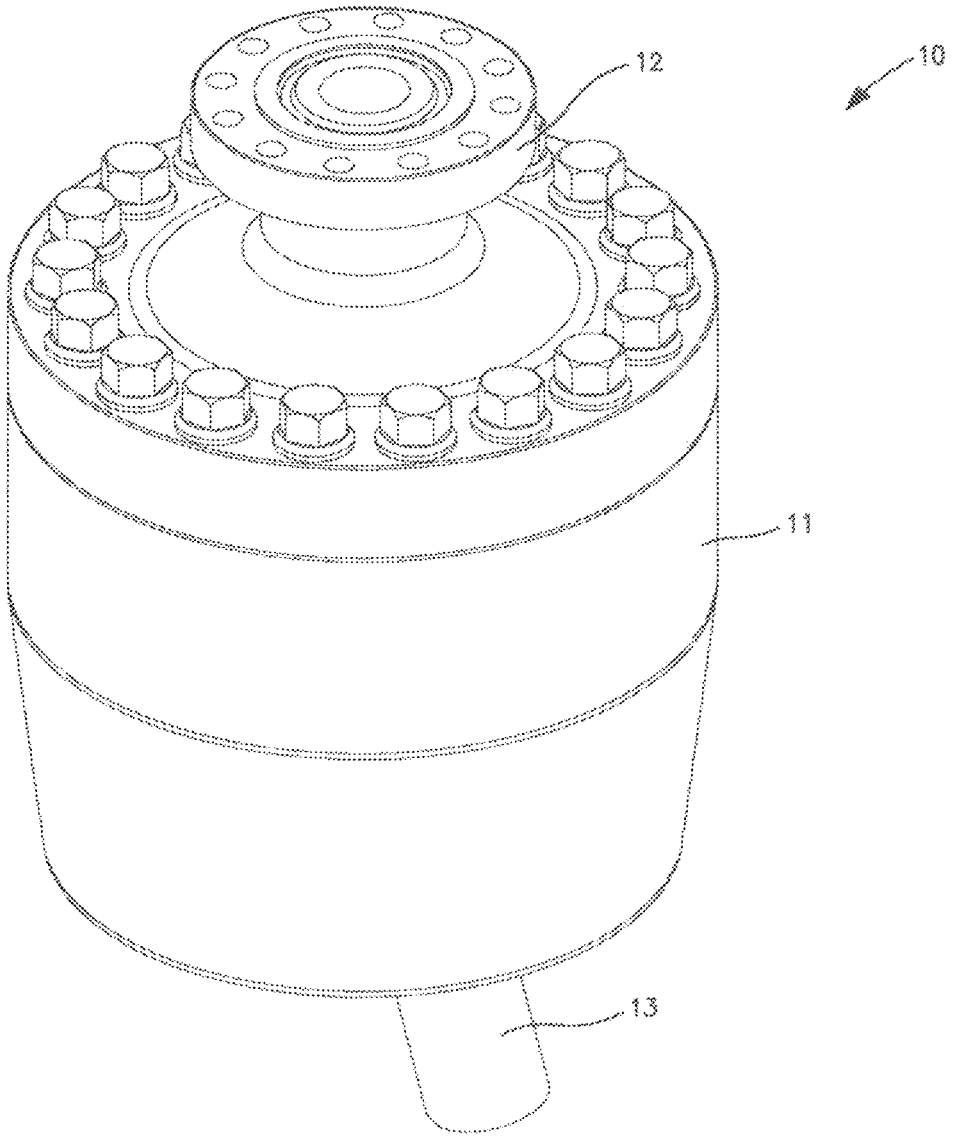
FIG. 1 is a perspective view of an exemplary conventional subsea flexible pipe joint.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to. . . . " Also, the term "couple" or "couples" is intended to mean either an indirect or direct connection. Thus, if a first device couples to a second device, that connection may be through a direct connection, or through an indirect connection via other devices and connections. In addition, as used herein, the terms "axial" and "axially" generally mean along or parallel to a central axis (e.g., central axis of a structure), while the terms "radial" and "radially" generally mean perpendicular to the central axis. For instance, an axial distance refers to a distance measured along or parallel to the central axis, and a radial distance means a distance measured perpendicular to the central axis.

Figure 2:
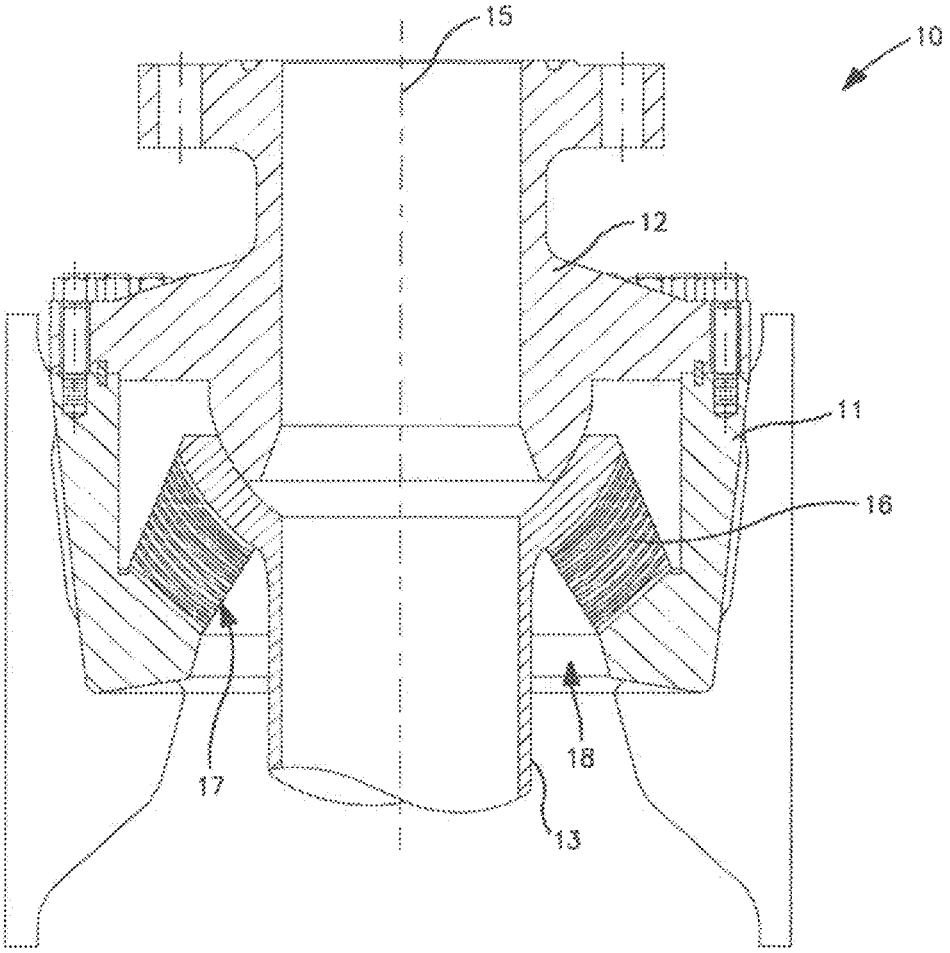
FIG. 2 is a cross-sectional view of the flexible pipe joint of FIG. 1.

Referring now to FIGS. 1 and 2, an exemplary conventional flexible pipe joint 10, also referred to as flex joint 10, is shown. Flex joint 10 is axially disposed between adjacent pipe sections of a subsea riser that are coupled end-to-end, and simultaneously allows for fluid flow between the pipe sections and bending or flexing of the riser. Thus, as used herein, the phrases "flexible pipe joint," "flexible joint," and "flex joint" are used to refer to any flexible stress joint disposed between adjacent tubular or pipe sections to simultaneously allow fluid flow therethrough and movement of the pipe sections relative to each other. In general, flex joint 10 may be designed and constructed to handle various fluid pressures, fluid flow rates, and fluid types.

Flex joint 10 includes a cylindrical body 11, an attachment flange 12 bolted to the upper end of body 11, and a riser extension 13 extending from body 11. Body 11, attachment flange 12, and riser extension 13 share, and are each generally symmetric about, a common central or longitudinal axis 15. Riser extension 13 may deflect angularly about its upper end relative to body 11 and attachment flange 12. Body 11, attachment flange 12, and riser extension 13 are typically made from a rigid, durable, corrosion resistant material such as steel.

Referring specifically to FIG. 2, a flex element 16 extends from body 11 to the upper end of riser extension 13, where flex element 16 sealingly engages riser extension 13. As a result, fluid communication between the fluids flowing through flex joint 10 and the environment external flex joint 10 is restricted and/or prevented. The lower surface of flex element 16 is covered and protected by a polymeric sheath or covering 17 such as an elastomeric material or rubber. As best shown in FIG. 2, an annular cavity or recess 18 is formed on the underside of flex joint 10 radially between flex element 16 and riser extension 13. Failures to flex element 16 may be dangerous and costly, and thus, flex joint 10 is typically subjected to routine maintenance, inspection, and cleaning. However, due to the geometry of cavity 18 inspection, accessing, and cleaning flex element 16 has conventionally been difficult without the risky use of human divers. Consequently, embodiments of flexible joint inspection and cleaning devices and tools described below are designed, configured, and constructed to address these issues while eliminating the need for human divers.

It should be appreciated that flex joint 10 shown and described with reference to FIGS. 1 and 2 is but one example of a conventional flex joint. Other examples of other flex joints are shown and described in U.S. Pat. No. 7,341,283, which is hereby incorporated herein by reference in its entirety for all purposes.

Figure 3:
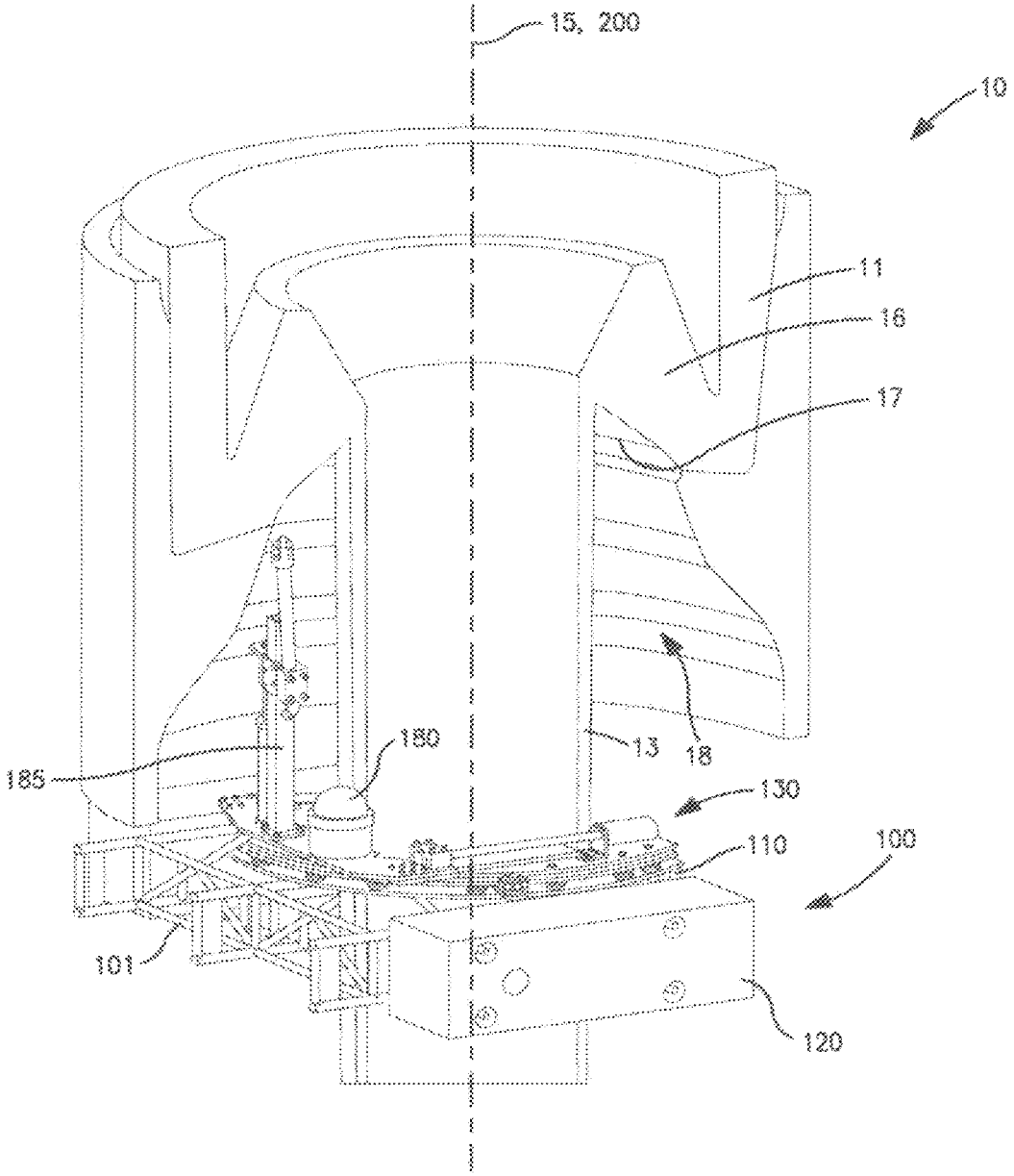
FIG. 3 is a partial cross-sectional perspective view of an embodiment of a flexible joint inspection and cleaning device in accordance with the principles described herein coupled to the subsea flex joint of FIG. 1 for inspection and/or cleaning operations.

Referring now to FIGS. 3-7, an embodiment of a flexible joint inspection and cleaning tool or device 100 for remotely inspecting and/or cleaning a subsea flexible joint (e.g., flex joint 10) or other subsea structure is shown. In FIG. 3, device 100 is shown coupled to flex joint 10 previously described, and in particular, disposed about riser extension 13 of flex joint 10, and positioned to inspect and/or clean flex element 16 and polymeric covering 17 via annular recess 18 on the underside of flex joint 10. For purposes of clarity, attachment flange 26 is not shown in FIG. 3. As will be described in more detail below, device 100 is an underwater remotely operated vehicle (ROV) or robotic device that is remotely controlled (e.g., from the surface structure) to inspect and/or clean subsea flexible pipe joints. Although FIG. 3 shows device 100 positioned to inspect and/or clean flex joint 10 previously described, in general, embodiments described herein may be used to inspect and/or clean any type of flex joint or other subsea structure.

Figure 4:
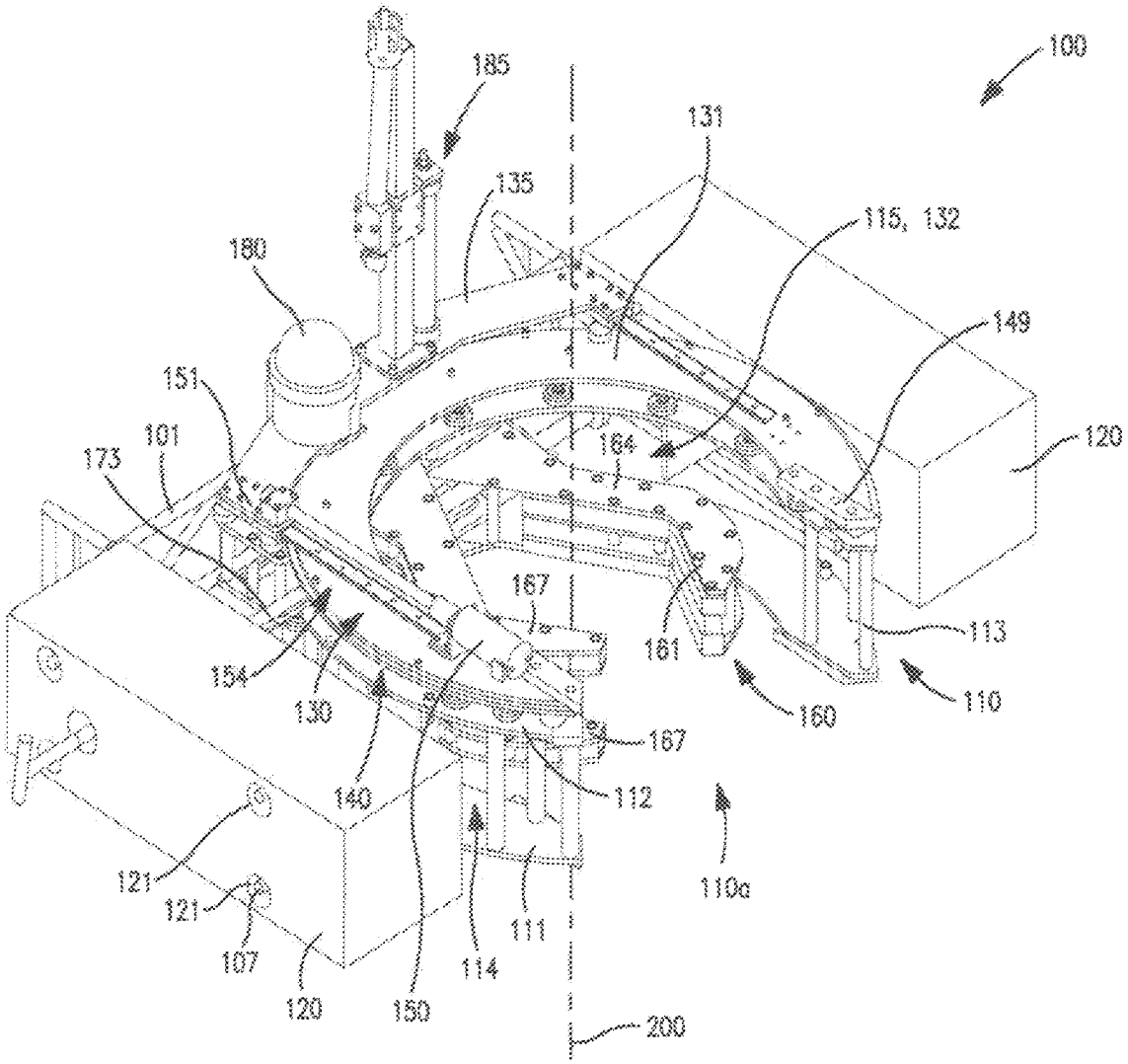
FIG. 4 is a perspective view of the flexible joint inspection and cleaning device of FIG. 3.
Figure 5:
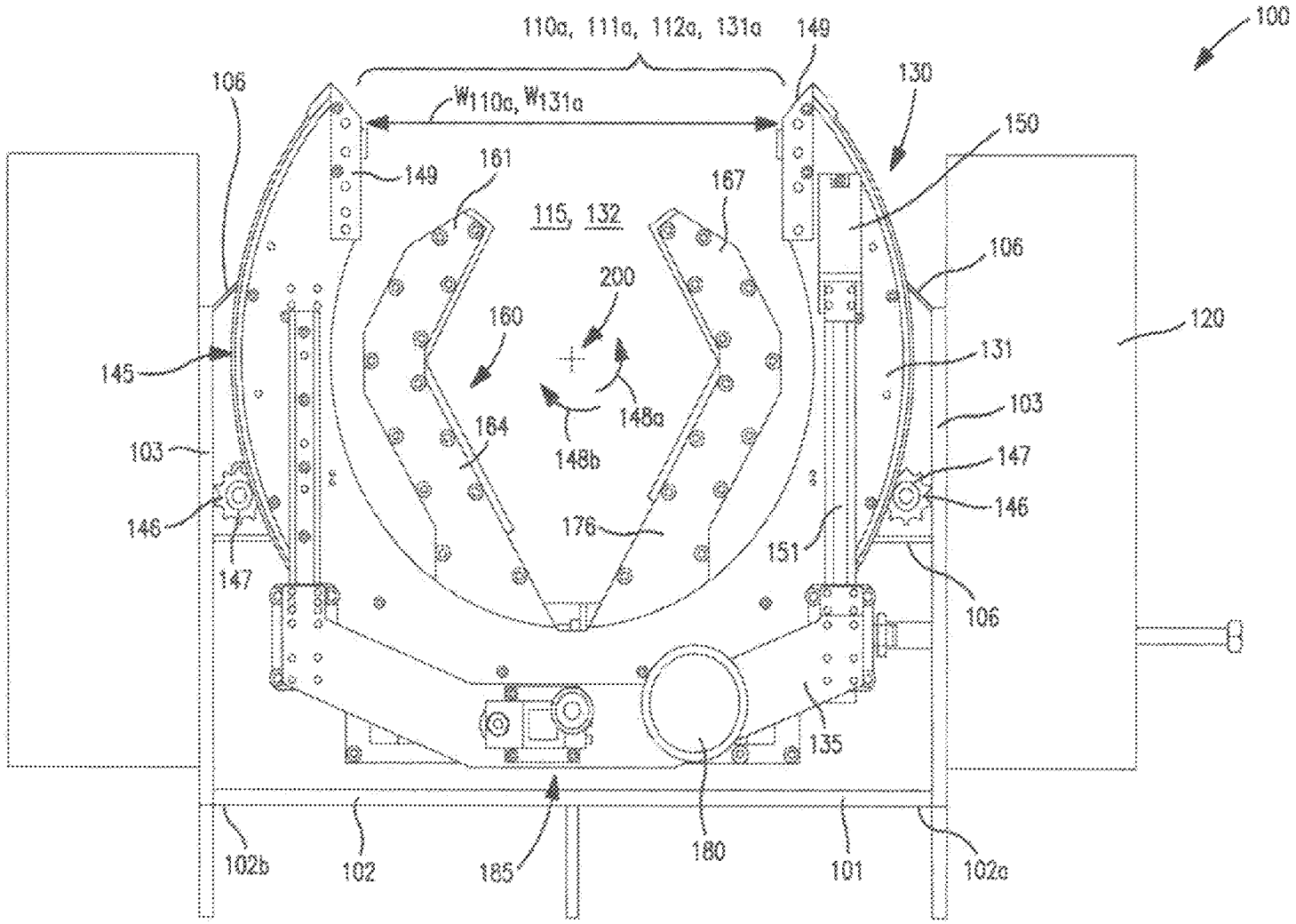
FIG. 5 is a top view of the flexible joint inspection and cleaning device of FIG. 3.

Device 100 comprises a frame 101, a support assembly 110 coupled to frame 101, buoyancy control members 120 coupled to opposite sides of frame 101, an inspection and cleaning tool positioning assembly 130 rotatably coupled to support assembly 110, and a clamping assembly 160 coupled to frame 101. As best shown in FIGS. 3-5, support assembly 110, tool positioning assembly 130, and clamping assembly 160 are disposed about a central axis 200 that is generally parallel to and coincident with the central axis 15 of riser extension 13 when device 100 is coupled to riser extension 13. In addition, in this embodiment, device 100 includes an inspection camera 180 and cleaning assembly 185, both mounted to tool positioning assembly 130. During cleaning and inspection operations, clamping assembly 160 controllably secures device 100 to riser extension 13, and tool positioning assembly 130 controllably positions inspection camera 180 and cleaning assembly 185 in the desired orientation relative to flex joint 10.

Figure 6:
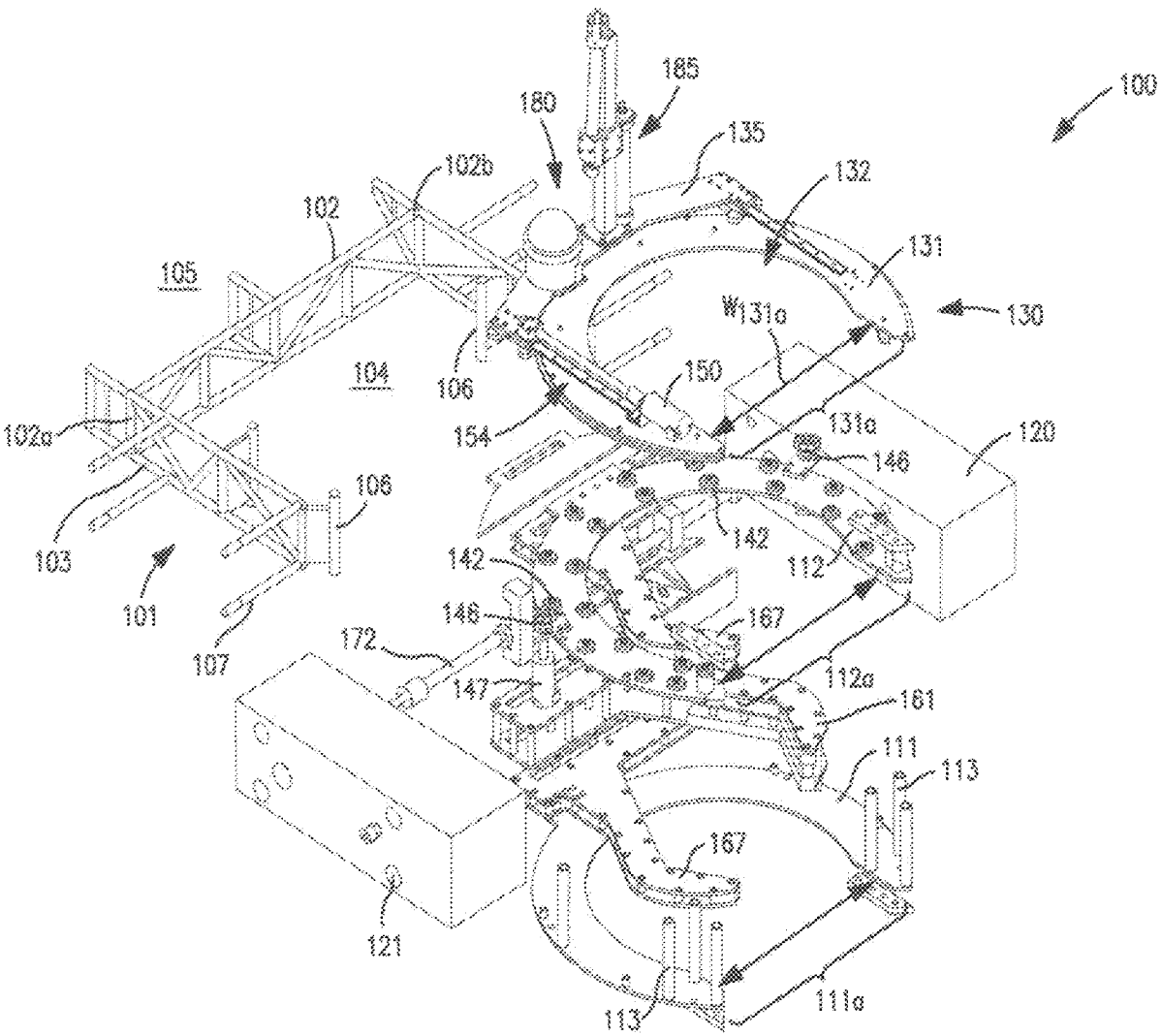
FIG. 6 is an exploded front perspective view the flexible joint inspection and cleaning device of FIG. 3.
Figure 7:
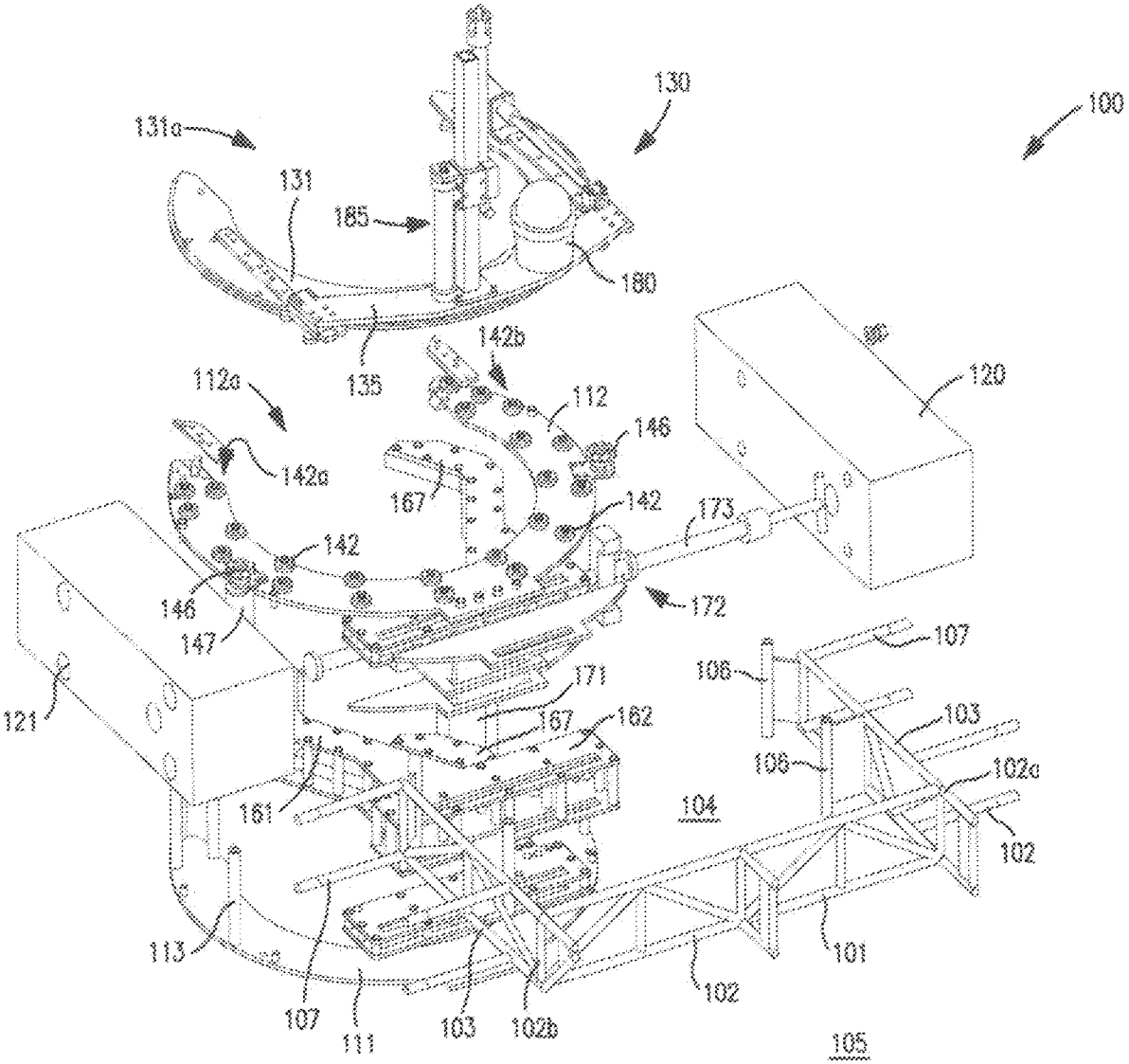
FIG. 7 is an exploded rear perspective view the flexible joint inspection and cleaning device of FIG. 3.

Referring now to FIGS. 4-7, frame 101 generally supports the components of device 100 (e.g., buoyancy control members 120, support assembly 110, clamping assembly 160, etc.) and provides the base structure to which the other components of device 100 are coupled. In this embodiment, frame 101 includes a generally rectangular base 102 having ends 102*a, b*, and a pair of support arms 103, each arm 103 extending generally perpendicularly from one of ends 102*a, b*. Arms 103 are fixed to base 102 such that arms 103 are not free to move translationally or rotationally relative to base 102. As best shown in FIGS. 6 and 7, together, base 102 and arms 103 form the generally C-shaped frame 101 that defines an inner or interior region 104 extending between arms 103 and generally within frame 101 and an outer or exterior region 105 generally outside frame 101.

Each arm 103 includes a plurality of inner mounts 106 extending from each arm 103 into inner region 104 and generally towards axis 200. In this embodiment, two inner mounts 106 extend from each arm 103 into inner region 104. Support assembly 110 is positioned between arms 103 and secured to frame 101 via inner mounts 106. Thus, support assembly 110, clamping assembly 160, tool positioning assembly 130, cleaning assembly 185, and camera 180 are coupled to and supported by inner mounts 106 and arms 103 of frame 101.

Each arm 103 also includes a plurality of outer mounts 107 extending from each arm 103 into outer region 105 and generally away from axis 200. In this embodiment, four outer mounts 107 extend perpendicularly from each arm 103 generally away from the remainder of frame 101. One buoyancy control member 120 is coupled to each arm 103 via outer mounts 107. In particular, outer mounts 107 of each arm 103 extend through mating through bores 121 in one of buoyancy control members 120. In general, mounts 107 may be secured within through bores 121 by any suitable means including, without limitation, interference fit, welding, adhesive, mating threads, a nut threaded onto the outer end of each mount, or combinations thereof. In this embodiment, outer mounts 107 are secured to buoyancy control members 120 via nuts threaded onto the ends of each outer mount 107 over washers. Thus, buoyancy control members 120 are coupled to and supported by outer mounts 107 and arms 103 of frame 101.

In general, frame 101 may comprise any suitable material including, without limitation, metals and metal alloys (e.g., steel, aluminum, etc.), non-metals (e.g., polymer, etc.), composites (e.g., carbon fiber and epoxy composite, etc.) or combinations thereof. Since frame 101 supports the components of device 100, which are subjected to harsh subsea condition, frame 101 preferably comprises a rigid and durable material such as stainless.

Referring again to FIGS. 3-7, buoyancy control members 120 are attached to arms 103 on opposite ends of frame 101. In general, buoyancy control members 120 function to maintain the balance, general horizontal orientation, and buoyancy of device 100. By adjusting the buoyancy of members 120, the buoyancy, and hence depth of device 100 relative to the sea surface, may be controlled, thereby enabling device 100 to move up or down along riser extension 13 as desired. For balance control, the buoyancy of each member 120 may be independently controlled such that each member 120 may simultaneously have different buoyancy, thereby enabling device 100 to maintain a generally balanced, horizontal subsea orientation in the event different vertical loads are applied to different portions of device 100.

Referring now to FIGS. 4-7, support assembly 110 is concentric about axis 200 and provides a base to which tool positioning assembly 130 and clamping assembly 160 are mounted. In this embodiment, support assembly 110 includes a first or lower support member 111, a second or upper support member 112 axially spaced from lower support member 111 relative to axis 200, and a plurality of elongate struts or connection members 113 extending axially, relative to axis 200, between support members 111, 112. Lower support member 111 and upper support member 112 are fixedly connected such that members 111, 112 do not move rotationally or translationally relative to each other. Due to the axial spacing of support members 111, 112, a void or gap 114 is formed axially between support members 111, 112.

In this embodiment, lower support member 111 and upper support member 112 each have a generally C-shaped geometry including an opening 111*a*, 112*a*, respectively. In this embodiment, members 111, 112 have substantially the same size and geometry. As best shown in FIGS. 4 and 5, support members 111, 112 of support assembly 110 are fixed to each with openings 111*a*, 112*a* angularly aligned relative to axis 200 (i.e., openings 111*a*, 112*a* are disposed at the same angular orientation about axis 200), thereby defining an opening 110*a* in support assembly 110 that provides access to a radially inner capture cavity or region 115 generally surrounded by and positioned within support assembly 110. Opening 110*a* has a width $W_{110a}$ measured between the opposed ends of support assembly 110 in a plane perpendicular to axis 200.

Referring now to FIGS. 3-7, 9, and 10, tool positioning assembly 130 includes a rotating member 131 and a tool support member 135. As will be described in more detail below, rotating member 131 is rotatably coupled to tool support 110, and tool support member 135 is movably coupled to rotating member 131. Further, as will be described in more detail below, rotating member 131 may be controllably rotated about axis 200 relative to support assembly 110 and clamping member assembly 130 to adjust the angular position of camera 180 and cleaning assembly 185 about axis 200, and tool support member may be controllably moved radially inward or radially outward relative to axis 200 and rotating member 131 to adjust the radial position of camera 180 and cleaning assembly 185 relative to axis 200. As a result, tool positioning assembly 130 allows for adjustment of the position of camera 180 and cleaning assembly 185 relative to flex joint 10.

Similar to support members 111, 112, rotating member 131 has a generally C-shaped geometry including an opening 131*a* having a width $W_{131a}$ measured between the opposed ends of rotating member 131 in a plane perpendicular to axis 200. As best shown in FIG. 5, opening 131*a* of rotating member 131 provides access to a radially inner capture cavity or region 132 generally surrounded by and positioned within rotating member 131. Since openings 110*a*, 131*a* provide access to capture cavities 115, 132, respectively, from external support assembly 110 and rotating member 131, respectively, openings 110*a*, 131*a* may also be referred to herein as "accesses" or "access openings."

In this embodiment, members 111, 112, 131 have substantially the same size and geometry. For example, in this embodiment, widths $W_{110a}$, $W_{131a}$ are the same. Although members 111, 112, 131 are shown as generally circular, in general, each ring 111, 112, 131 may have any suitable geometry adapted to receive a tubular (e.g., riser extension 13) or other object including, without limitation, oval, ovoid, octagonal, hexagonal, etc.

Referring again to FIGS. 3-7, rotating member 131 may be rotated about axis 200 relative to support assembly 110. When rotating member 131 is rotationally positioned with opening 131*a* substantially angularly aligned with opening 110*a* of support assembly 110 relative to axis 200 (i.e., openings 110*a*, 131*a* are disposed at substantially the same angular orientation about axis 200), riser extension 13 may pass through access openings 110*a*, 131*a* into inner cavities 115, 132, and subsequently be grasped by clamping assembly 160 described in more detail below. Accordingly, widths $W_{110a}$, $W_{131a}$ are preferably greater than the diameter or width of the object to be received. For example, for cleaning and/or inspecting a flex joint (e.g., flex joint 10), widths $W_{110a}$, $W_{131a}$ are preferably greater than the diameter of riser extension 13 such that riser extension 13 may pass through access openings 110*a*, 131*a* into capture cavities 115, 132.

Referring now to FIGS. 6-10, in this embodiment, rotating member 131 is rotatably coupled to tool support 110 with a roller assembly 140 disposed axially between rotating member 131 and tool support 110. In this embodiment, roller assembly 140 includes a roller track 141 coupled to the axially lower surface of rotating member 131 (FIGS. 8-10) and a plurality of roller members 142 coupled to the axially upper surface of upper support member 112 (FIGS. 6 and 7). Thus, roller track 141 and roller members 142 are axially positioned between rotating member 131 and support member 112. Roller track 141 and roller members 142 secure rotating member 131 to support assembly 110, while simultaneously allowing rotation of rotating member 131 relative to support assembly 110 about axis 200. Although rotating member 131 is shown and described as rotatably coupled to tool support 110 with roller assembly 140 in this embodiment, in other embodiments, alternative assemblies and means may be provided to rotatably couple the rotating member (e.g., rotating member 131) to the tool support (e.g., tool support 110).

Figure 8:
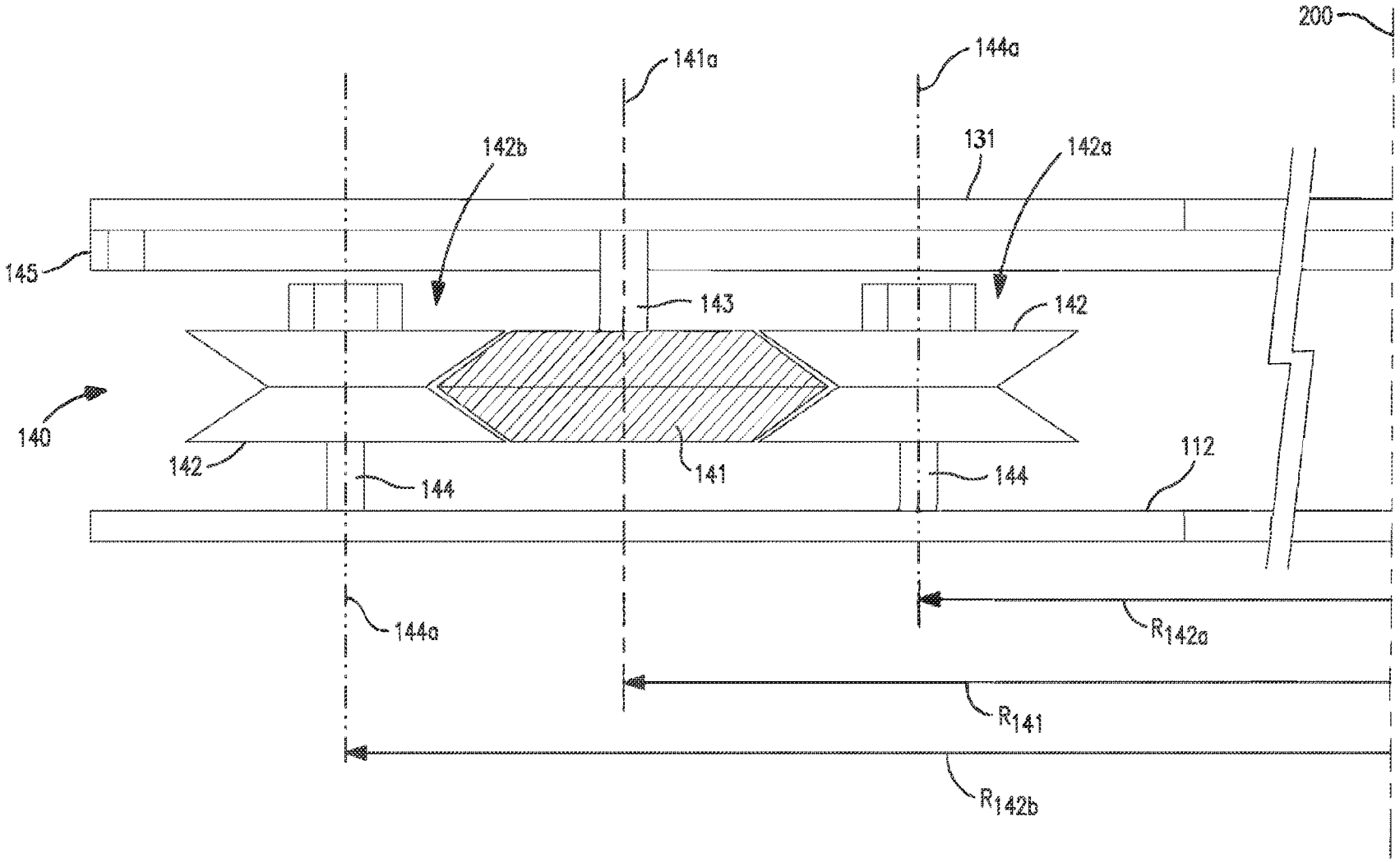
FIG. 8 is an enlarged schematic cross-sectional view of the roller assembly of the flexible joint inspection and cleaning device of FIG. 3.
Figure 10:
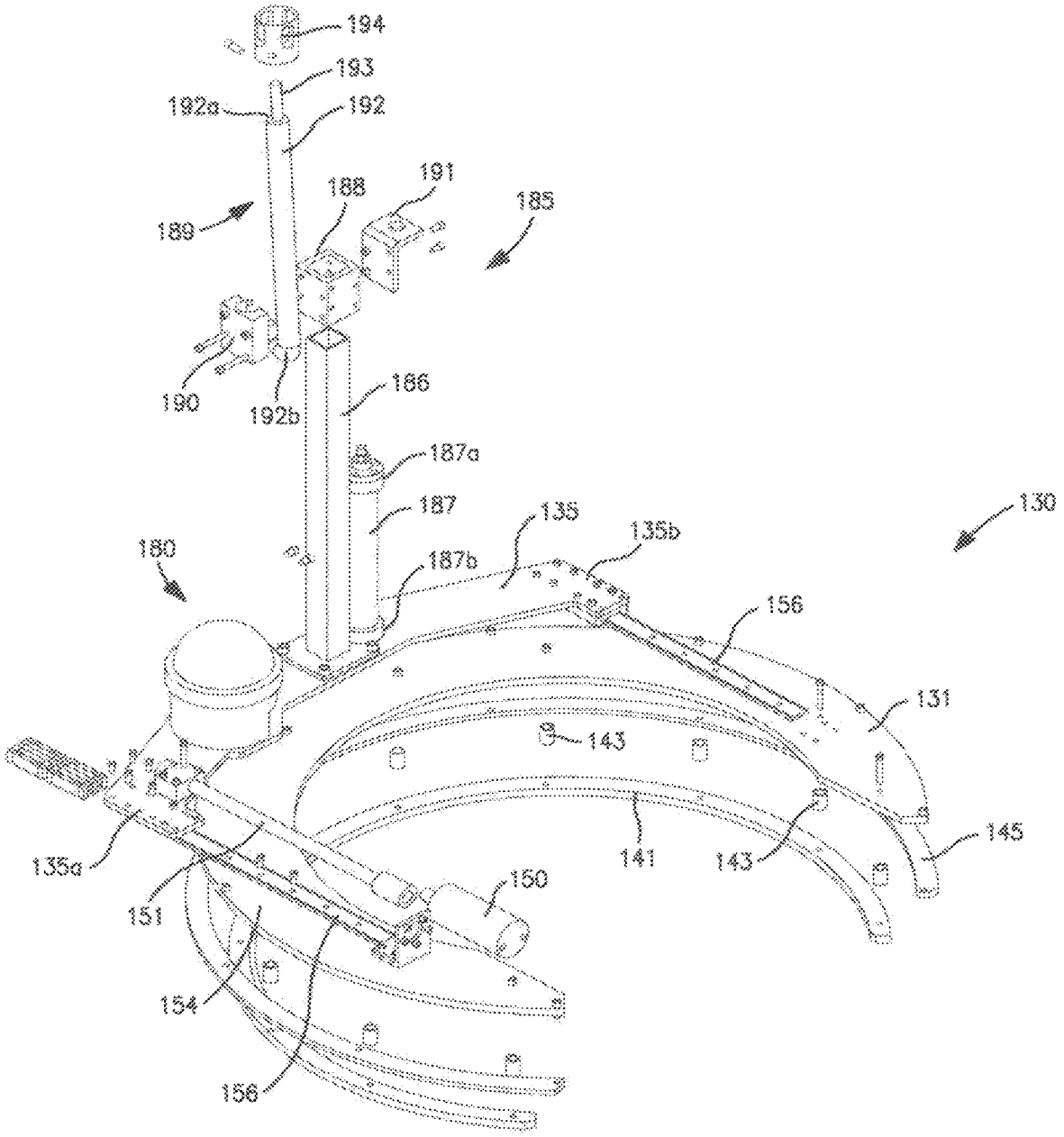
FIG. 10 is an exploded front perspective view of the tool positioning assembly of the flexible joint inspection and cleaning device of FIG. 3.

As best shown in FIGS. 8 and 10, roller track 141 is coupled to and axially spaced below rotating member 131 with a plurality of circumferentially spaced roller track attachment members 143 and a plurality of screws. In this embodiment, each attachment member 143 is coupled to rotating member 131 and roller track 141 by a screw that extends axially through a through bore in rotating member 131 and a through bore in attachment member 143, and threads into roller track 141. Thus, in this embodiment, rotating member 131, roller track 141, and attachment members 143 are separate and distinct components that are coupled together with screws. However, in other embodiments, the rotating member (e.g., rotating member 131), the roller track (e.g., roller track 141), the attachment member(s) (e.g., attachment members 143), or combinations thereof may be integral or monolithic. Further, although roller track 143 is coupled to attachment members 143 and rotating member 131 with screws in this embodiment, in generally, any suitable method may be employed to couple the roller track (e.g., roller track 143) and the attachment members (e.g., attachment members 143) to the rotating member (e.g., rotating member 131) including, without limitation, bolts, welding, adhesive, or combinations thereof.

As best shown in FIGS. 6-8, roller members 142 are coupled to and axially spaced above upper support member 112 by shafts 144 extending axially from upper support member 112. Each roller member 142 is rotatably coupled to a shaft 144 such that each roller member 142 is free to rotate about an axis 144*a* of its respective shaft 144. Accordingly central axis 144*a* of each shaft 144 may also be referred to as an axis of rotation 144*a* of its respective roller member 142. In this embodiment, axes 144*a* are parallel to axis 200.

Roller track 141 is positioned, configured, and sized to engage and mate with roller members 142. As best shown in FIGS. 6-8, attachment members 143 and roller track 141 are each disposed at a uniform radial distance $R_{141}$ measured radially from axis 200 to the middle or centerline 141*a* of roller track 141, which, in this embodiment, coincides with the central axis of each attachment member 143 and is parallel to axis 200. Further, roller members 142 are arranged in two annular rows—a first set of the plurality of roller members 142 are circumferentially spaced along a radially inner or first annular row 142*a*, and a second set of the plurality of roller members 142 are circumferentially spaced along a radially outer or second annular row 142*b*. Each roller member 142 in first annular row 142*a* is disposed at the same radial distance $R_{142a}$ measured radially from axis 200 to its respective axis of rotation 144*a*, and each roller member 142 in second annular row 142*b* is disposed at the same radial distance $R_{142b}$ measured radially from axis 200 to its respective axis of rotation 144*a*. Radial distance $R_{142b}$ is greater than radial distance $R_{142a}$, and radial distance $R_{141}$ is between radial distances $R_{142a}$, $R_{142b}$. Specifically, radial distances $R_{142a}$, $R_{142b}$, $R_{141}$ are determined and set such that roller track 141 passes between and engages roller members 142 in rows 142*a*, 142*b*.

Moreover, as best shown in FIG. 8, in this embodiment, the radially inner and outer surfaces of roller track 141 (relative to axis 200) are shaped and sized to positively engage the radially outer surfaces of roller members 142 (relative to axis 144*a*). In particular, the radially inner and radially outer surfaces of roller track 141 (relative to axis 200) are outwardly extending or generally convex V-shaped surfaces adapted to mate with a V-shaped surface or recess on the radially outer surfaces of roller members 142. This interlocking arrangement of roller members 142 and roller track 141 allows rotation of rotating member 131 about axis 200 relative to upper support member 112 while simultaneously restricting and/or preventing decoupling of rotating member 131 and upper support member 112.

Referring now to FIGS. 5 and 8-10, a toothed track 145 extends along the radially outer edge or periphery of rotating member 131. In this embodiment, a toothed track 145 extends along the entire periphery of rotating member 131 and is coupled to the axially lower surface of rotating member 131 with a plurality of screws. As best shown in FIGS. 5-7, toothed track 145 meshes with a pair of circumferentially spaced sprockets 146, each sprocket 146 coupled to and rotated by a motor 147 directly attached to support assembly 110. Motors 147 drive the rotation of sprockets 146, which engage toothed track 145 and drive the rotation of rotating member 131 about axis 200 relative to support assembly 110. Motors 147 are configured to rotate sprocket 146 in either direction (i.e. clockwise or counter-clockwise), and thus, drive the rotation of rotating member 131 in a counterclockwise direction about axis 200 as represented by arrow 148*a* or a clockwise direction about axis 200 as represented by arrow 148*b* as shown in FIG. 5. A rotation limiting or stop member 149 is disposed on each end of rotating member 131 proximal opening 131*a* to restrict and/or prevent the over-rotation of rotating member 131 relative to support assembly 110. In this embodiment, motor 147 is a hydraulic motor. However, in general, the motor (e.g., motor 147) may comprise any suitable motor including, without limitation, a hydraulic motor, an electric motor, a pneumatic motor, etc.

Referring now to FIGS. 4, 5, 9, and 10, as previously described, tool support member 135 is movably coupled to rotating member 131. In this embodiment, tool support member 135 is limited to linear movements relative to rotating member 131 and radial movement relative to axis 200. In particular, a motor 150 powers the movement of tool support member 135, and a guide assembly 154 positioned between tool support member 135 and rotating member 131 restricts and limits the direction of movement of tool support member 135.

Figure 9:
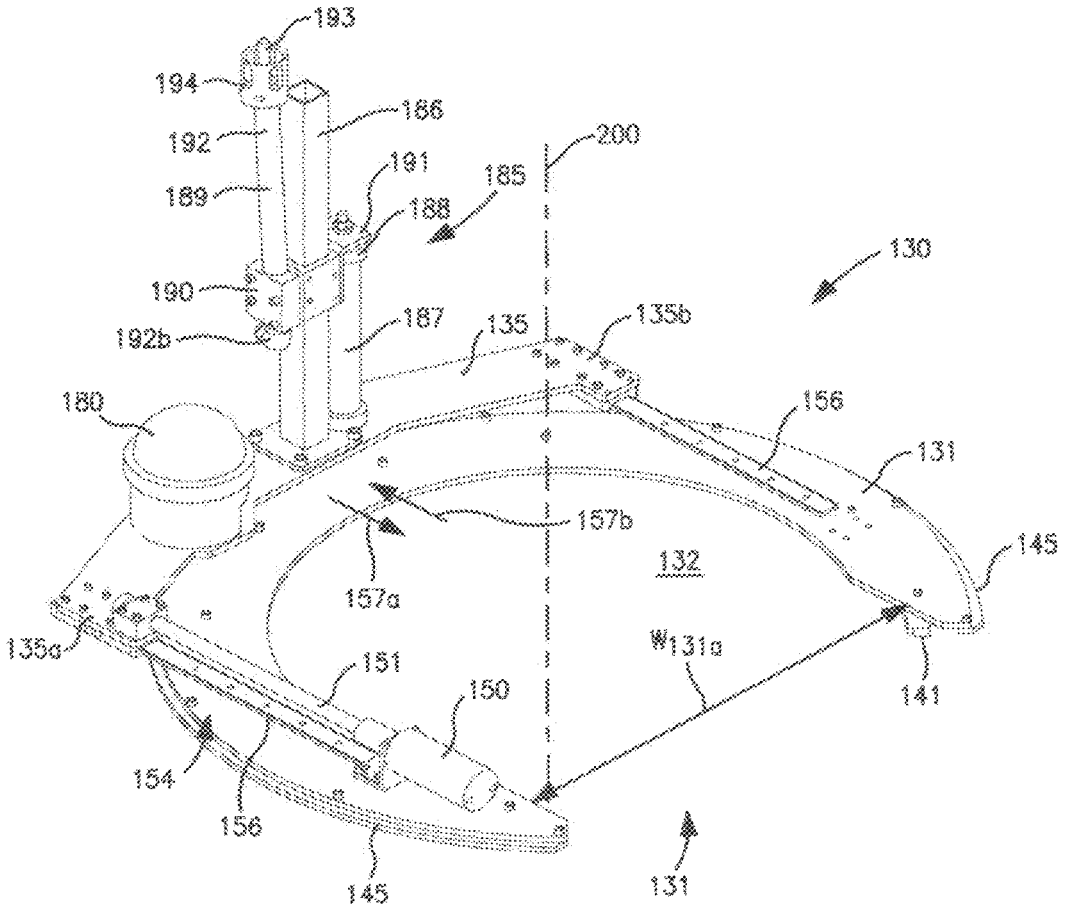
FIG. 9 is a front perspective view of the tool positioning assembly of the flexible joint inspection and cleaning device of FIG. 3.

Referring now to FIGS. 9 and 10, guide assembly 154 includes a pair of guide members 155 and a pair of elongate, linear, and parallel guide tracks 156. Support member 135 extends between a first end 135*a* proximal one arm 103 and a second end 135*b* proximal the other arm 103. One guide member 155 is directly attached to the axially lower surface of support member 135 at each end 135*a, b* such that guide members 155 are not free to move rotationally or translationally relative to support member 135. In addition, parallel guide tracks 156 are directly attached to the axially upper surface of rotating member 131 on opposite sides of inner region 132. Each guide member 155 mates with and slidingly engages one of guide tracks 156, which restrict and control the movement of guide members 155 relative to rotating member 131, thereby restricting and controlling the movement of support member 135 relative to rotating member 131. Guides tracks 156 allow support member 135 to move linearly relative to rotating member 131 in a radially inward or first direction 157*a* parallel to guide tracks 156 and a radially outward or second direction 157*b* parallel to guide tracks 156 and opposite to first direction 157*a*. However, guide tracks 156 restrict and/or prevent support member 135 from moving perpendicular to guide tracks 156, and further, restrict and/or prevent support member 135 from rotating relative to guide tracks 156 and rotating member 131. In this embodiment, guide tracks 156 are T-slide rails and guide members 155 are T-slide blocks that slidingly receive the T-slide rails. However, in general, any suitable mating guide assembly may be used to control and/or restrict the movement of the support member (e.g., support member 135).

The linear movement of support member 135 along guide tracks 156 is powered by motor 150 mounted to rotating ring 131 and a drive shaft 151 having a first end 151*a* coupled to motor 150 and a second end 151*b* coupled to tool support member 135. In general, the motor (e.g., motor 150) may be configured to apply a linear force to the drive shaft (e.g., drive shaft 151) parallel to the guide tracks (e.g., guide tracks 156) to move the support member (e.g., support member 135) linearly, or alternatively, the motor may be configured to rotate the drive shaft, which in turn rotates a gear or sprocket that meshes with teeth on the guide track to move the support member linearly. In this embodiment, motor 150 is a hydraulic motor. However, in general, the motor (e.g., motor 150) may comprise any suitable motor including, without limitation, a hydraulic motor, an electric motor, a pneumatic motor, etc.

Referring now to FIGS. 3, 4, 9, and 10, camera 180 is mounted to support member 135 and extends axially upward from support member 135. As best shown in FIG. 3, camera 180 allows a remote operator or user of device 100 to remotely visually inspect flex joint 10 and visually observe the cleaning of flex joint 10. In general, camera 180 may comprise any suitable camera for subsea use such as an LED, underwater camera. One example of a suitable camera is Model OE14-113 commercially available from Kongsberg®. In this embodiment, camera 180 employs a focus motor controlled through I/O board and a zoom lens. Video signals are transmitted from camera 180 along a video link to an I/O board for transmission to the sea surface and the remote operator. Camera 180 preferably has pan-and-tilt and zoom capabilities so as to allow the remote user to thoroughly visualize and inspect flex joint 10. Camera 180 collect images of flex joint 10 and the surfaces of flex joint 10, which are transmitted to the sea surface and the remote operator.

In other embodiments, the camera (e.g., camera 180) may comprise a three-dimensional (3-D) imaging camera such as a high resolution digital still camera. In such embodiment, the camera may collect images of the flex joint (e.g., flex joint 10), which are then transmitted to the sea surface. The collected high resolution image stills may be digitally processed using software to generate three-dimensional models of the flex joint for failure and integrity analysis. The three-dimensional models of the flex joint may be used to analyze the flex joint for wear and tear, build-up, etc. The generated three-dimensional models may further provide information as where to clean the flex joint, thereby enhancing the cleaning efficiency and functionality of the cleaning device (e.g., device 100). In other words, the device (e.g., device 100) may also be used to inspect the flex joint as well as for cleaning purposes.

Although the embodiment of device 100 shown in FIG. 3 includes one camera 180, in other embodiments, the flex joint inspection and cleaning device (e.g., device 100) may include, without limitation, additional cameras (e.g., camera 180), sensors or transducers, monitoring devices, or combinations thereof. Examples of other sensors and monitoring devices include, without limitation, temperatures sensors, pressure sensors, pH sensors, etc.

Referring still to FIGS. 3, 4, 9, and 10 cleaning assembly 185 is mounted to the axially upper surface of tool support member 135 and extends axially upward from tool support member 135 to enable penetration into annular recess 18 on the underside of flex joint 10. As best shown in FIG. 3, cleaning assembly 185 allows a remote operator or user of device 100 to remotely clean flex joint 10. In general, cleaning assembly 185 may comprise any suitable device or assembly for cleaning flex joint 10 to remove algae, marine life, or other undesirable materials that may have accumulated on or attached to flex joint 10.

Referring specifically to FIGS. 9 and 10, in this embodiment, cleaning assembly 185 comprises a slide post 186, an extension member 187, a slide block 188, and a cleaning device 189. Slide post 186 is directly attached to tool support member 135 and extends axially upward from tool support member 135 relative to axis 200. In this embodiment, slide post 186 is a tubular having a square cross-section, however, in general, the slide post (e.g., slide post 186) may have any suitable cross-section (e.g., circular cross-section, rectangular cross-section, etc.). Slide block 188 is disposed about slide post 186 and slidably engages slide post 186. Thus, slide block 188 may be controllably moved axially upward and downward along slide post 186.

Cleaning device 189 moves axially up and down slide post 186 along with slide block 188. In particular, cleaning device 189 is coupled to slide block 188 with a retainer 190 such cleaning device 189 does not move translationally or rotationally relative to slide block 188. Thus, as slide block 188 moves axially upward relative to axis 200, cleaning device 189 moves axially upward relative to axis 200. The controlled axial movement of cleaning device 189 enables cleaning device 189 to be extended into annular recess 18 of the underside of flex joint 10 for enhanced cleaning.

Referring still to FIGS. 9 and 10, extension member 187 is directly attached to tool support member 135 adjacent slide post 186. Extension member 187 has a first or upper end 187*a* distal tool support member 135, a second or lower end 187*b* secured to tool support member 135, and a length measured axially between ends 187*a, b*. Lower end 187*b* is attached to tool support member 135 such that lower end 187*b* does not move rotationally or translationally relative to tool support member 135. However, extension member 187 is configured to controllably extend axially, thereby increasing or decreasing its axial length and moving upper end 187*a* axially towards and away from tool support member 135. Upper end 187*a* of extension member 187 is coupled to slide block 188 with a bracket 191 such that upper end 187*a* does not move translationally or rotationally relative to slide block 188. Thus, as extension member 187 axially extends or contracts, upper end 187*a*, slide block 188, and cleaning device 189 move axially up and down, respectively, relative to tool support member 135 and axis 200. In this embodiment, extension member 187 is a hydraulic cylinder. However, in general, the extension member (e.g., extension member 187) may comprise any suitable device capable of providing an axial force to move the slide block (e.g., slide block 188) axially upward and downward along the slide post (e.g., slide post 186).

In the embodiment shown in FIGS. 3, 4, 9, and 10, cleaning device 189 is a nozzle cleaning assembly comprising an elongate tubular body 192, a nozzle 193, and a nozzle guard 194. Body 192 extends axially between a first or upper end 192*a* distal tool support member 135 and a second or lower end 192*b* proximal tool support member 135. Thus, body 192 is oriented generally parallel to slide post 186 and axis 200. Nozzle 193 is disposed at upper end 192*a* of body 192 and is protected by nozzle guard 194, which is disposed about nozzle 193 at upper end 192*a*. During cleaning operations, a cleaning fluid (e.g., seawater) is pumped under high pressure (e.g., 2,500 to 3,500 psi at a flow rate between 8 and 12 gpm) through body 192 from lower end 192*b* to upper end 192*a* and nozzle 193. For example, in one embodiment, seawater pumped at a flow rate of about 10 gpm and a pressure of about 3,150 psi flows through nozzle 193. The cleaning fluid is emitted or sprayed by nozzle 193 at a relatively high velocity to clean the surface of flex joint 10. In this embodiment, nozzle 193 is a cavitation nozzle that ejects the cleaning fluid at a sufficient velocity to cause cavitation or collapse of bubbles for more effective cleaning. One example of a suitable cavitation nozzle is the Caviblaster™ nozzle commercially available from Cavidyne™ of Gainesville, Fla.

Figure 11:
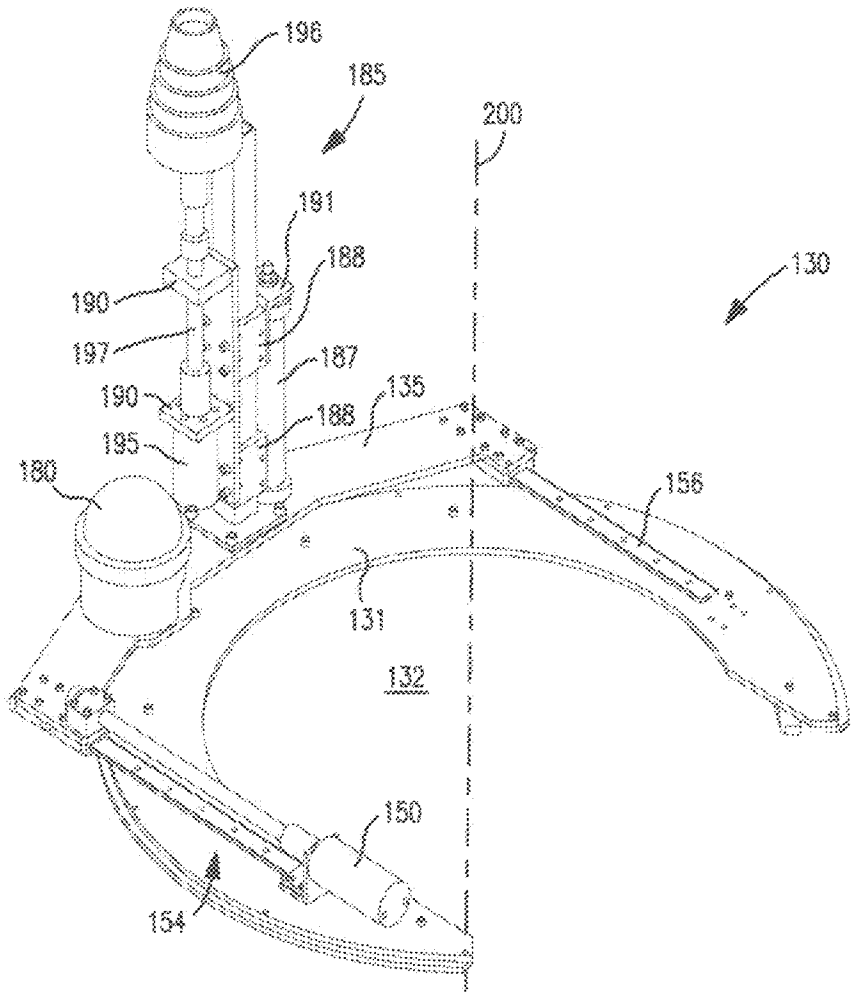
FIG. 11 is a front perspective view of the tool positioning assembly of the flexible joint inspection and cleaning device of FIG. 3 including an alternative embodiment of a cleaning device.
Figure 12:
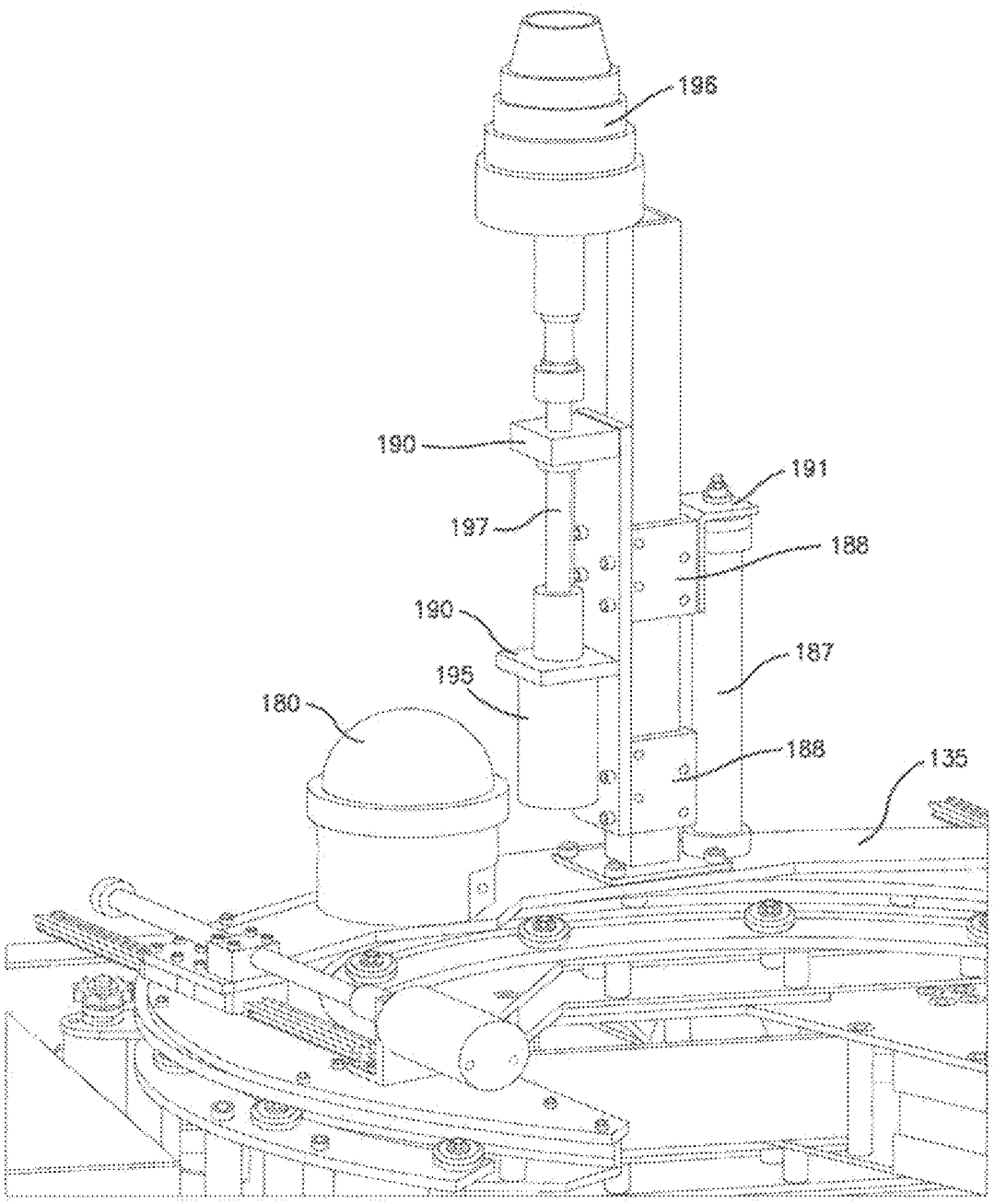
FIG. 12 is an enlarged partial perspective view of the cleaning assembly of FIG. 11.
Figure 13:
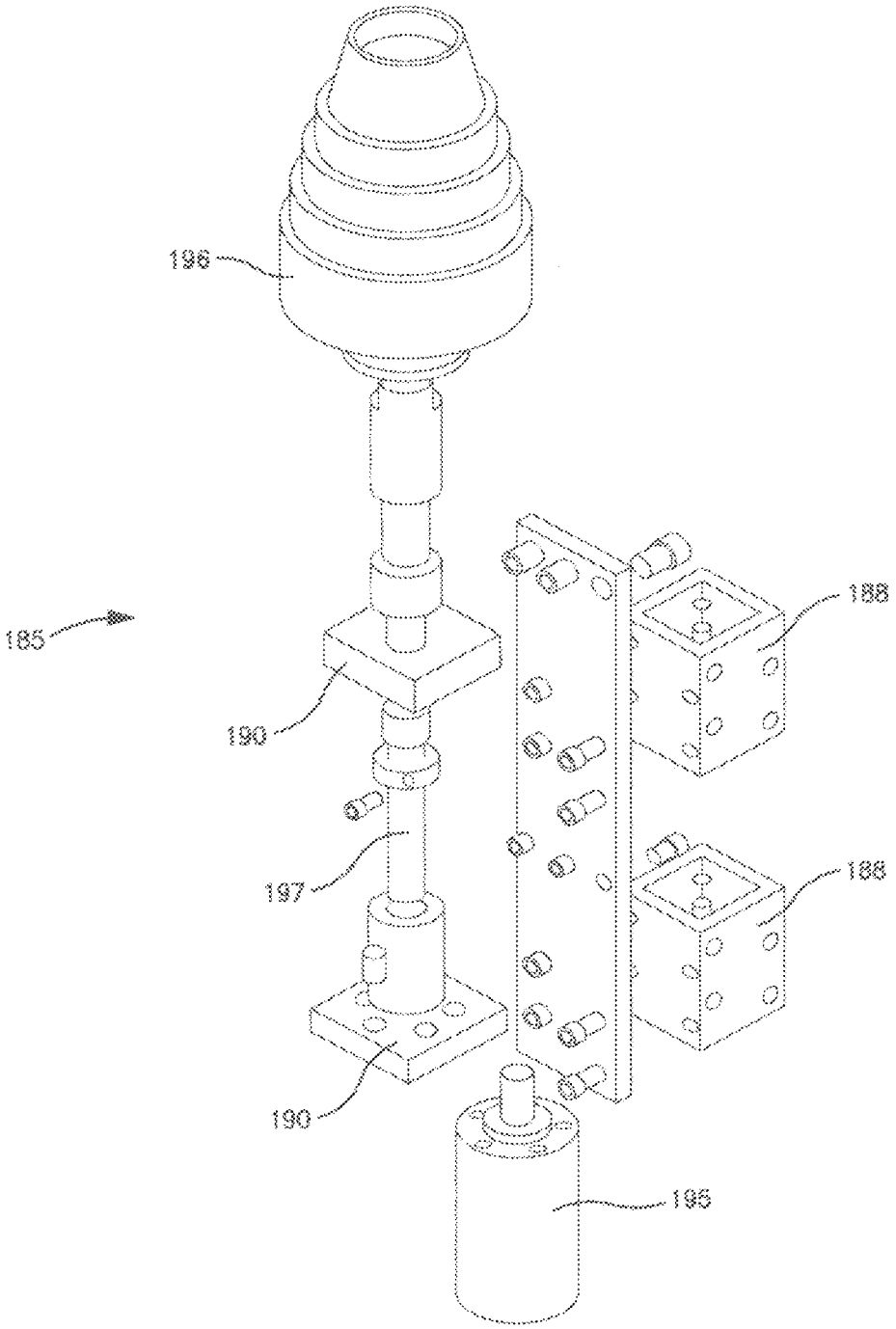
FIG. 13 is an exploded front perspective view of the cleaning assembly of FIG. 11.

Referring now to FIGS. 11-13, in this embodiment, cleaning device 189 is a brush cleaning assembly comprising a motor 195, a brush head 196, and a drive shaft 197 extending between motor 195 and brush head 196. Motor 195 is positioned proximal tool support member 135 axially below brush head 196. In addition, motor 195 drives the rotation of drive shaft 197, which in turn drives the rotation of brush head 196. Motor 195 and drive shaft 197 are coupled to a pair of slide blocks 188 with a pair of retainers 190 as previously described. In the manner previously described, cleaning device 189 including brush head 196 may be moved axially upward or downward relative to tool support member 135 and slide post 186 with extension member 187.

As shown in FIGS. 3, 4, 9, and 10, device 100 includes a cleaning device 189 that is a nozzle cleaning assembly, and as shown in FIGS. 11-13, device 100 includes a cleaning device 189 that is a brush cleaning assembly. Cleaning device 189 may be changed from a nozzle cleaning assembly to a brush cleaning assembly or vice versa by decoupling bracket 191 from upper end 187*a* of extension member 187, axially advancing slide block(s) 188 along slide post 186 away from tool support member 135 to remove cleaning device 189 from slide post 186, and then axially advancing slide block(s) 188 coupled to the other cleaning device 189 along slide post 186 towards tool support member 135, and coupling bracket 191 of the new cleaning device 189 to upper end 187*a* of extension member 187.

Although device 100 is shown in FIGS. 3, 4, 9, and 10 with a cleaning device 189 that is a nozzle cleaning assembly, and shown in FIGS. 11-13 with a cleaning device 189 that is a brush cleaning assembly, in other embodiments, the flexible joint inspection and cleaning device (e.g., device 100) may include a nozzle cleaning assembly, a brush cleaning assembly, other suitable cleaning device, or combinations thereof. For example, embodiments of a flexible joint inspection and cleaning device in accordance with the principles described herein may include both a nozzle cleaning assembly and a brush cleaning assembly.

As previously described, rotating member 131 is controllably rotated, clockwise or counterclockwise about axis 200, relative to support assembly 110; tool support member 135 is controllably moved linearly relative to support assembly 110 (e.g., radially inward and radially outward relative to axis 200); and further, cleaning device 185 is controllably moved away from or towards tool support member 135 (e.g., axially up or down relative to axis 200). Thus, cleaning assembly 185 may be described as having at least three degrees of freedom or movement—rotational movement about axis 200, radially movement relative to axis 200, and axial movement relative to axis 200. Having at least three degrees of freedom of movement offers the potential for enhance cleaning effectiveness and accuracy.

Referring now to FIGS. 3-7, clamping assembly 160 is adapted to couple tool 100 to flex joint 10 for subsequent inspection and/or cleaning operations. As shown in FIG. 3, clamping assembly 160 secures tool 100 to riser extension 13. Clamping assembly 160 is axially positioned between upper support member 112 and lower support member 113 of support assembly 110, and extends from proximal base 102 of frame 101 into inner region 115. In this embodiment, clamping assembly 160 includes a first clamping member 161, a pair of second clamping members 167 generally positioned opposed first clamping member 161 on the opposite side of axis 200, and a clamp drive assembly 172.

Figure 15:
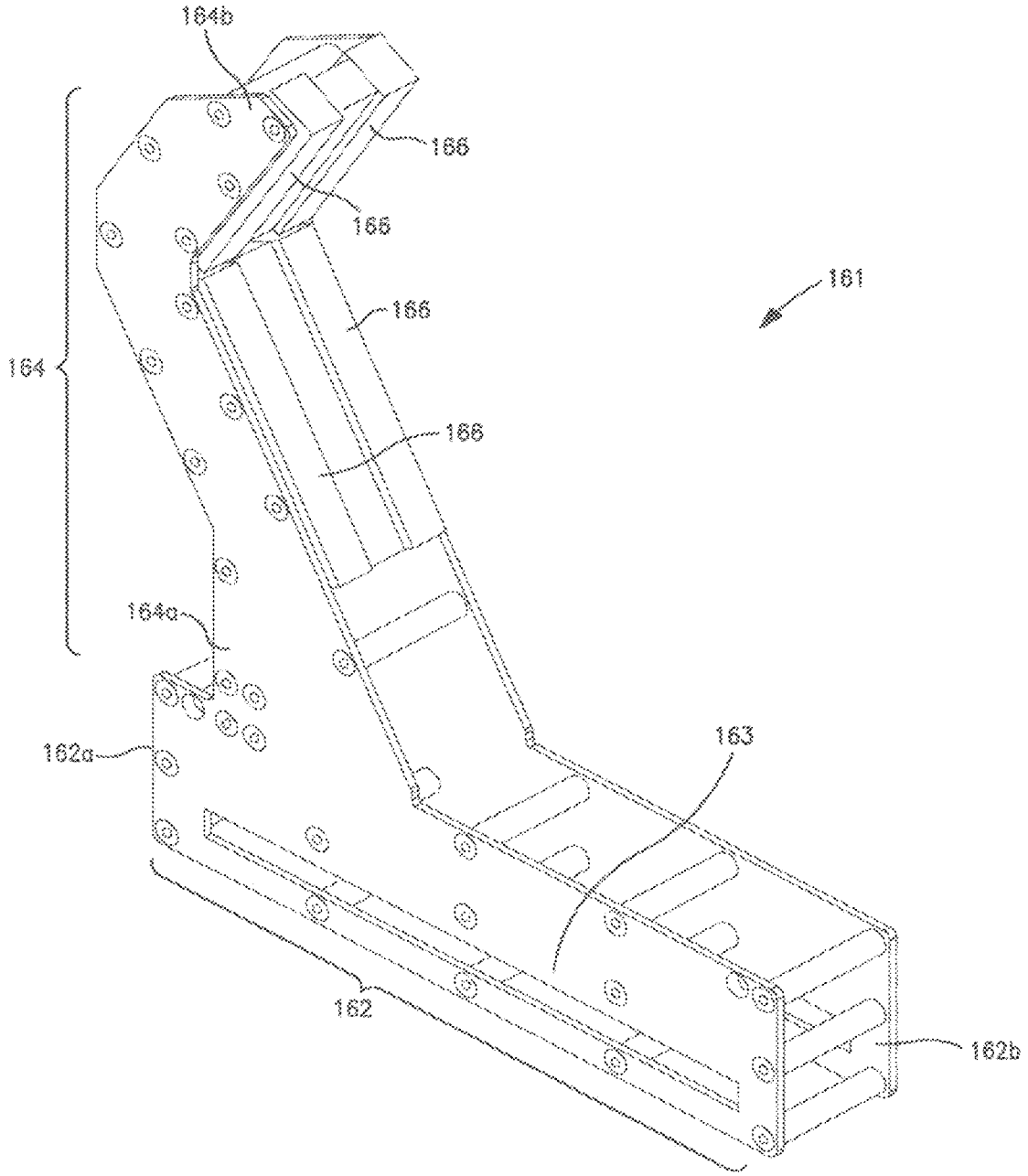

Referring now to FIGS. 4-7 and 15, first clamping member 161 includes an elongate base 162 oriented generally parallel to base 102 of frame 101. Base 162 extends linearly between a first end 162*a* proximal one arm 103 of frame 101 and a second end 162*b* proximal the opposite arm 103 of frame 101. An elongate through slot 163 extends linearly along base 162 from proximal first end 162*a* to proximal second end 162*b*. In addition, first clamping member 161 includes a clamping arm 164 extending perpendicularly or at an acute angle from base 162. Clamping arm 164 is generally C-shaped and has a fixed end 164*a* integral with base 162 proximal first end 162*a* and a free end 164*b* positioned in inner region 115 of support assembly 110. The radially inner surface of clamping arm 164 (relative to axis 200) engages riser extension 13 and is generally concave such that clamping arm 164 extends around a portion of riser extension. In this embodiment, the radially inner surface of clamping arm 164 is generally V-shaped, and as a result, clamping arm 164 engages riser extension 13 along at least two portions of the radially inner surface. As best shown in FIG. 15, clamping arm 164 includes gripping elements 166 that extend along the portions of the radially inner surface of clamping arm 164 that are intended to engage riser extension 13. Gripping elements 166 are designed to contact and grip riser extension 13 without damaging riser extension 13. Gripping elements 166 preferably comprise a relatively high friction and resilient material such rubber.

Figure 14:
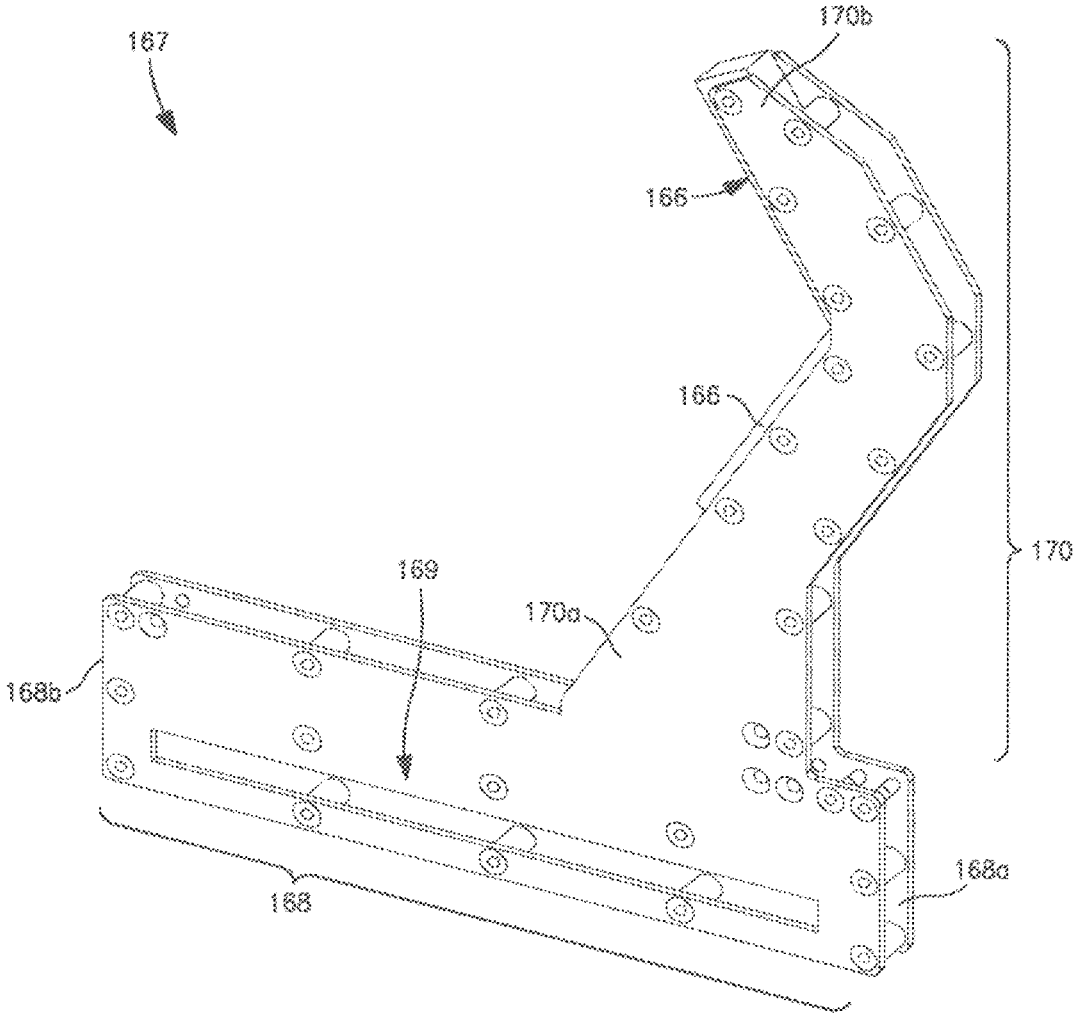
FIGS. 14 and 15 are perspective views of the clamping arms of the flexible joint inspection and cleaning device of FIG. 3.

Referring now to FIGS. 4-7 and 14, second clamping members 167 are axially spaced apart, but coupled together such that second clamping members 167 do not move translationally or rotationally relative to each other. Second clamping members 167 are similar to clamping member 161 previously described. In particular, each second clamping member 167 includes an elongate base 168 oriented generally parallel to base 102 of frame 101. Base 168 extends linearly between a first end 168*a* proximal one arm 103 of frame 101 and a second end 168*b* proximal the opposite arm 103 of frame 101. An elongate through slot 169 extends linearly along base 168 from proximal first end 168*a* to proximal second end 168*b*. In addition, each second clamping member 167 includes a clamping arm 170 extending perpendicularly or at an acute angle from base 168. Each clamping arm 170 is generally C-shaped and has a fixed end 170*a* integral with base 168 proximal first end 168*b*, and a free end 170*b* positioned in inner region 115 of support assembly 110. The radially inner surface of each clamping arm 167 (relative to axis 200) engages riser extension 13 and is generally concave such that clamping arm 170 extends around a portion of riser extension. In this embodiment, the radially inner surface of each clamping arm 170 is generally V-shaped, and as a result, each clamping arm 170 engages riser extension 13 along at least two portions of the radially inner surface. As best shown in FIG. 14, each clamping arm 170 includes gripping elements 166 that extend along the radially inner surface of each clamping arm 170. As previously described, gripping elements 166 are designed to contact and grip riser extension 13 without damaging riser extension 13, and further, gripping elements 166 preferably comprise a relatively high friction and resilient material such rubber.

As best shown in FIGS. 4, 6, and 7, first clamping member 161 is axially disposed between second clamping members 167 relative to axis 200. More specifically, base 162 of first clamping member 161 is axially disposed between bases 168 of second clamping members 167. Base 162 is positioned in an overlapping relationship with bases 168 of second clamping members 167 such that through slots 163, 169 are aligned. Due to the overlapping relationship of bases 162, 168, clamping arms 164, 170 accommodate each other as they move closer together. An elongate guide plate 171 (FIG. 7) extends axially through each through slot 163, 169, thereby coupling clamping members 161, 167 together and guiding the movement of clamping members 161, 167 relative to each other. Guide plate 171 has a length measured parallel to through slots 163, 169 that is less than the length of through slots 163, 169. Thus, clamping members 161, 167 are free to move relative to guide plate 171, however, guide plate 171 limits the movement of clamping members 161, 167 to a back-and-forth motions parallel to slots 163, 169. In other words, clamping members 161, 167 are restricted by the engagement of slots 163, 169 and guide plate 171 from moving perpendicular to guide plate 171 and rotationally relative to guide plate 171.

Further, clamping members 161, 167 are arranged such that end 162*a* of base 162 is positioned proximal one arm 103 of frame 101, and both ends 168*a* of bases 168 are positioned proximal the opposite arm 103 of frame 101. Thus, clamping members 161, 167 are positioned and oriented such gripping elements 166 of clamping arm 164 generally opposed or facing gripping elements 166 of both clamping arms 170 with each gripping member 166 positioned to engage riser extension 13.

Figure 16:
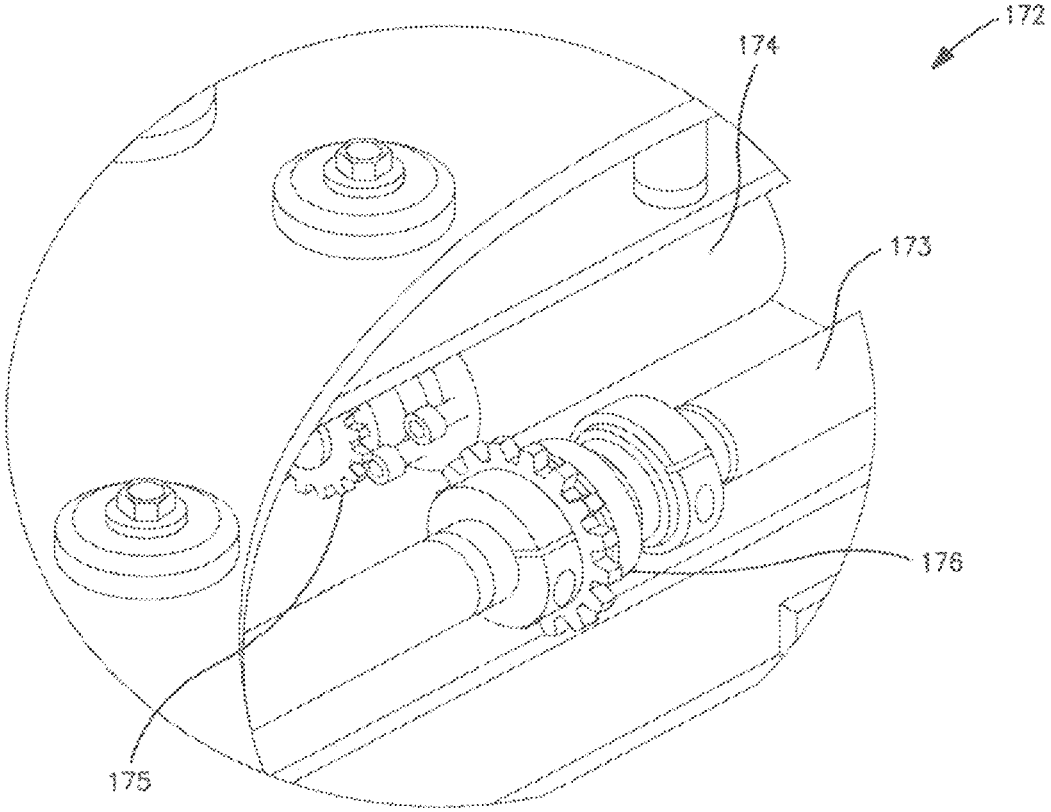
FIG. 16 is an enlarged perspective view of the clamping arm drive assembly of the of the flexible joint inspection and cleaning device of FIG. 3.

Referring now to FIGS. 6, 7, and 16, clamp drive assembly 172 actuates clamping assembly 160 to move clamping arms 164, 170 radially inward (relative to axis 200) and towards each other to engage riser extension 13, and to move clamping arms 164, 170 radially outward (relative to axis 200) and away from each other to disengage riser extension 13. Clamp drive assembly 172 includes a threaded clamping screw 173 that extends generally parallel to slots 163, 169 and a clamp motor 174 that powers the rotation of screw 173. Clamping screw 173 is double threaded, with one set of threads threadingly coupled to clamping member 161 and the other set of threads threadingly coupled to clamping member 167. Consequently, rotation of clamping screw 173 in a first direction 173*a* actuates clamping arms 164, 170 to move radially inward (relative to axis 200) and towards each other, and rotation of clamping screw 173 in the opposite direction 173*b* actuates clamping arms 164, 170 to move radially outward (relative to axis 200) and away from each other.

As best shown in FIG. 16, clamp motor 174 rotates clamp screw 173 and, in this embodiment, is positioned proximal the overlapping portions of bases 162, 168. In this embodiment, clamp motor 174 drives the rotation of clamp screw 173 via a clamp motor gear 175 rotated by clamp motor 174 that meshes with and engages a mating gear 176 on clamp screw 173. Clamp motor 174 drives the rotation of gear 175, which in turn drives the rotation of gear 176 and clamp screw 173. In general, the clamp motor (e.g., clamp motor 174) may comprise any suitable motor including, without limitation, a hydraulic motor, an electric motor, a pneumatic motor, etc.

Referring now to FIGS. 3-5, during inspection and/or cleaning operations, clamping assembly 160 is positioned in an open position with clamping arms 164, 170 spaced apart in their retracted position, and access openings 110*a*, 131*a* are angularly aligned relative to axis 200. Next, device 100 is positioned with axis 200 substantially aligned with axis 15 of riser extension 13, and device 100 is urged toward riser extension 13 such that riser extension 13 passes through access openings 110*a*, 131*a* into inner regions 115, 132 between clamping arms 164, 170. With riser extension 13 positioned between clamping arms 164, 170, clamping assembly 160 may be actuated to a closed position with clamping arms 164, 170 moved radially inward relative to axis 200 and into engagement with riser extension 13. Once clamping arms 164, 170 securely engage riser extension 13, inspection and/or cleaning operations may be performed with camera 180 and cleaning assembly 185.

Figure 17:
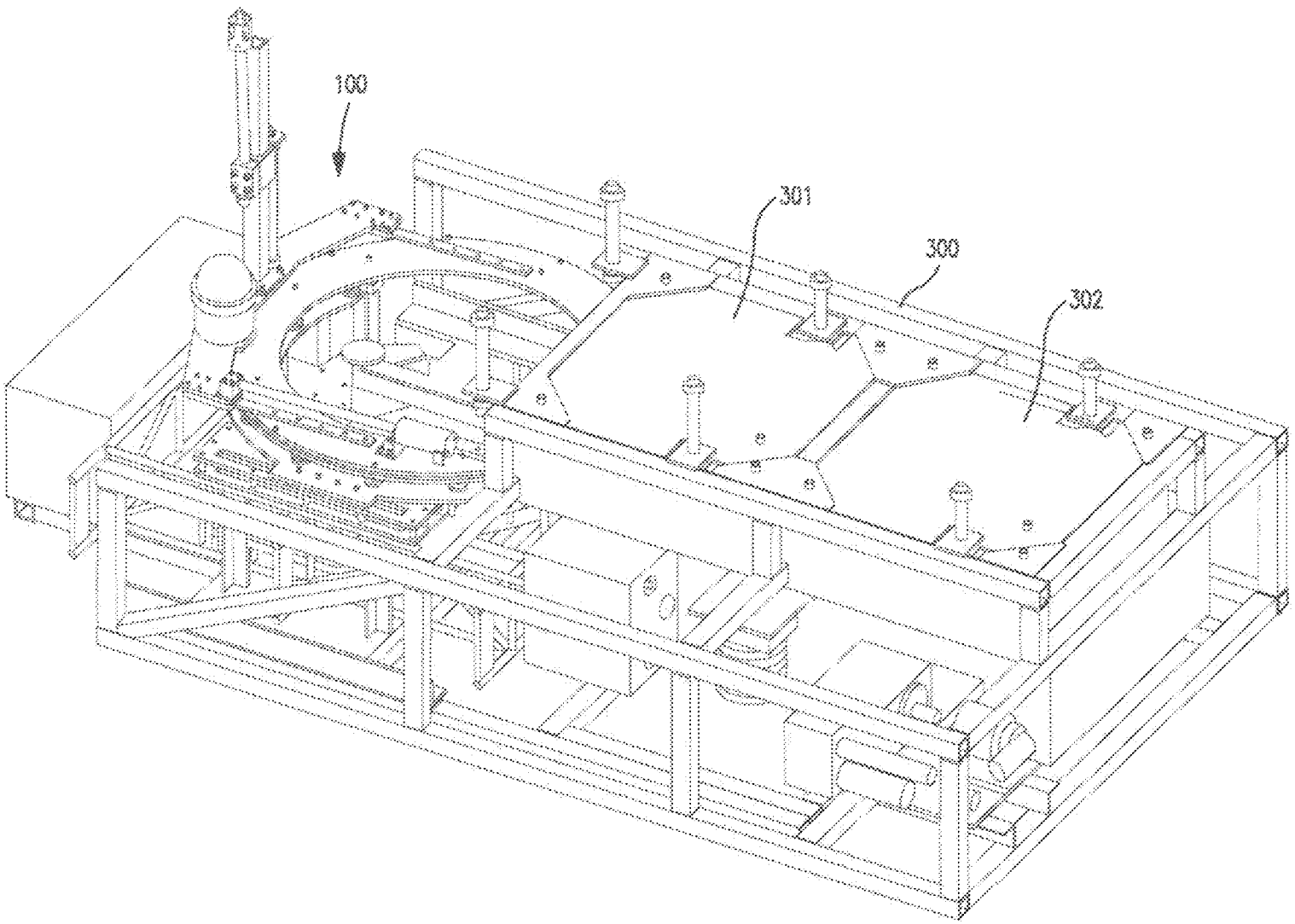
FIG. 17 is a perspective view of an embodiment of a deployment apparatus for deploying embodiments of the flexible joint inspection and cleaning devices disclosed herein.

Embodiments of device 100 are preferably capable of being remotely deployed and operated subsea from an offshore rig or other structure disposed on land or at the sea surface. In FIG. 17, device 100 is shown coupled to a deployment skid 300. Deployment skid 300 is configured to releasably receive device 100 and also contain compartments 301, 302 for a cavitation pump and other electronics.

As mentioned above, system 300 is preferably configured to be operated remotely from a surface vessel. Accordingly, tool 100 and skid 300 may have umbilical connections which run to the surface vessel where the tool 100 may be operated by a user. User may control tool 100 with software running on a computer system.

In general, the components of device 100 and deployment skid 200 may be fabricated from any suitable material(s) including, without limitation, metals and metal alloys (e.g., aluminum, steel, etc.), non-metals (e.g., polymer, rubber, ceramic, etc.), composites (e.g., carbon fiber and epoxy composite, etc.), or combinations thereof. However, the components of device 100 and deployment skid 200 are preferably made from materials that are durable and resistant to conditions experienced in harsh subsea environments. For example, rotating ring 131, tool support member 135, and support assembly 120 may be made from 316 stainless steel. Other metals and metal alloys such as a aluminum may also be used.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

The discussion of a reference is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A method for cleaning a subsea flexible pipe joint including a body having a central axis, a riser extension having an upper end disposed within the body and pivotally coupled to the body, and a flex element extending radially from the body to the riser extension, the method comprising:

(a) clamping a base of a cleaning tool to the riser extension vertically below the flex element of the flexible pipe joint;

(b) extending a cleaning device axially with respect to the central axis away from a tool support member coupled to the base and into an annular recess radially positioned between the flex element and the riser extension after (a), wherein (b) comprises extending the cleaning device axially along a post that is attached to the tool support member;

(c) rotating a rotating member relative to the base to move the cleaning tool and tool support member circumferentially about the central axis relative to the flex element;

(d) linearly translating the tool support member radially with respect to the central axis along a track that is attached to the rotating member;

(e) linearly translating the cleaning device radially with respect to the central axis, relative to the flex element during (d);

(f) positioning the cleaning device axially adjacent the flex element as a result of (b), (c), (d) and (e); and (g) cleaning at least a portion of the flex element with the cleaning device after (b)-(f).

2. The method of claim 1, wherein (c) comprises:

engaging a second track mounted to the rotating member with a plurality of rollers.

3. The method of claim 1, further comprising:

inspecting the flex joint with a camera mounted to the tool support member during (g); and moving the camera radially relative to the flex element with the cleaning device during (d).

4. The method of claim 1, further comprising:

adjusting the buoyancy of the cleaning tool to move the base axially upward or downward along the riser extension.

5. The method of claim 1, further comprising:

receiving the riser extension into an opening of the base before (b).

6. The method of claim 1, wherein the cleaning device comprises a nozzle, and wherein (g) comprises emitting a cleaning fluid from the nozzle in an axial direction against the flex element.

7. The method of claim 6, wherein (g) comprises supplying the cleaning fluid to the nozzle at a pressure of 2500 psi to 3500 psi and a flow rate of 8.0 gpm to 12.0 gpm.

8. The method of claim 1, wherein the cleaning device comprises a brush head, and wherein (g) comprises rotating the brush head and engaging the brush head with the flex element.

9. The method of claim 1, wherein (b) comprises moving a slide block along the post, wherein the cleaning device is coupled to the slide block.

10. The method of claim 5, comprising receiving the riser extension into a cavity of the base before (a), wherein (d) comprises linearly translating the tool support member along a pair of parallel tracks, wherein the pair of parallel tracks comprise the track, and wherein the pair of parallel tracks are positioned on opposite sides of the cavity.

* * * * *